US010569145B2

(12) United States Patent
Beach et al.

(10) Patent No.: US 10,569,145 B2
(45) Date of Patent: Feb. 25, 2020

(54) GOLF CLUB

(71) Applicant: Taylor Made Golf Company, Inc., Carlsbad, CA (US)

(72) Inventors: Todd P. Beach, Encinitas, CA (US); John Francis Lorentzen, El Cajon, CA (US); Bing-Ling Chao, San Diego, CA (US); Mark Vincent Greaney, Vista, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 16/102,293

(22) Filed: Aug. 13, 2018

(65) Prior Publication Data

US 2018/0345097 A1 Dec. 6, 2018

Related U.S. Application Data

(63) Continuation of application No. 15/838,682, filed on Dec. 12, 2017, now Pat. No. 10,226,671, which is a (Continued)

(51) Int. Cl.
*A63B 53/04* (2015.01)

(52) U.S. Cl.
CPC .. *A63B 53/0466* (2013.01); *A63B 2053/0408* (2013.01); *A63B 2053/0412* (2013.01); (Continued)

(58) Field of Classification Search
CPC ..... A63B 53/0466; A63B 53/04; A63B 2053/0433; A63B 2053/0491; A63B 2053/0408; A63B 2053/0437
See application file for complete search history.

(56) References Cited

U.S. PATENT DOCUMENTS 782,955 A 2/1905 Emens
796,802 A 8/1905 Brown
(Continued)

FOREIGN PATENT DOCUMENTS

DE 9012884 9/1990
EP 0446935 9/1991
(Continued)

OTHER PUBLICATIONS

Office Action with English translation received in related Japan Application No. 214-235213, dated Aug. 23, 2018, 5 pages.
(Continued)

*Primary Examiner* — John E Simms, Jr.
(74) *Attorney, Agent, or Firm* — Klarquist Sparkman, LLP

(57) ABSTRACT

A golf club head includes a club body including a crown, a sole, a skirt disposed between and connecting the crown and the sole and a face portion connected to a front end of the club body. The face portion includes a geometric center defining the origin of a coordinate system when the golf club head is ideally positioned, the coordinate system including an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis. The golf club head defines a center of gravity CG, the CG being a distance $CG_Y$ from the origin as measured along the y-axis and a distance $CG_Z$ from the origin as measured along the z-axis.

30 Claims, 14 Drawing Sheets

Related U.S. Application Data continuation of application No. 14/144,105, filed on Dec. 30, 2013, now Pat. No. 9,861,864.

(60) Provisional application No. 61/909,964, filed on Nov. 27, 2013.

(52) U.S. Cl.
CPC ..... *A63B 2053/0433* (2013.01); *A63B 2053/0491* (2013.01)

(56) References Cited

U.S. PATENT DOCUMENTS 1,133,129 A 3/1915 Govan
1,454,267 A 5/1923 Challis et al.
D63,284 S 11/1923 Challis
1,518,316 A 12/1924 Ellingham
1,526,438 A 2/1925 Scott
1,538,312 A 5/1925 Beat
1,592,463 A 7/1926 Marker
1,623,523 A 4/1927 Bourke
1,650,183 A 11/1927 Brooks
1,658,581 A 2/1928 Tobia
1,704,119 A 3/1929 Buhrke
1,890,538 A 12/1932 Hadden
1,895,417 A 1/1933 Lard
1,946,134 A 2/1934 Dyce
1,970,409 A 8/1934 Wiedemann
2,020,679 A 11/1935 Fitzpatrick
2,083,189 A 6/1937 Crooker
D107,007 S 11/1937 Cashmore
2,214,356 A 9/1940 Wettlaufer
2,219,670 A 10/1940 Wettlaufer
2,225,930 A 12/1940 Sexton
2,225,931 A 12/1940 Sexton
2,360,364 A 10/1944 Reach
2,460,435 A 2/1949 Schaffer
2,464,850 A 3/1949 Crawshaw
2,681,523 A 6/1954 Sellers
3,064,980 A 11/1962 Steiner
3,085,804 A 4/1963 Pieper
3,166,320 A 1/1965 Onions
3,266,805 A 8/1966 Bulla
3,424,459 A 1/1969 Evancho
3,466,047 A 9/1969 Rodia et al.
3,468,544 A 9/1969 Antonious
3,486,755 A 12/1969 Hodge
3,524,646 A 8/1970 Wheeler
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,692,306 A 9/1972 Glover
3,743,297 A 7/1973 Dennis
3,829,092 A 8/1974 Arkin
3,836,153 A 9/1974 Dance, Jr.
3,840,231 A 10/1974 Moore
3,848,737 A 11/1974 Kenon
3,891,212 A 6/1975 Hill
3,893,670 A 7/1975 Franchi
3,893,672 A 7/1975 Schonher
3,897,066 A 7/1975 Belmont
3,937,474 A 2/1976 Jepson et al.
3,976,299 A 8/1976 Lawrence et al.
3,979,122 A 9/1976 Belmont
3,979,123 A * 9/1976 Belmont ..... A63B 53/04 473/337
3,985,363 A 10/1976 Jepson et al.
3,997,170 A 12/1976 Goldberg
4,008,896 A 2/1977 Gordos
4,043,563 A 8/1977 Churchward
4,052,075 A 10/1977 Daly
4,065,133 A 12/1977 Gordos
4,076,254 A 2/1978 Nygren
4,077,633 A 3/1978 Studen
4,085,934 A 4/1978 Churchward
4,121,832 A 10/1978 Ebbing
4,139,196 A 2/1979 Riley
4,147,349 A 4/1979 Jeghers
4,165,076 A 8/1979 Cella
4,193,601 A 3/1980 Reid, Jr. et al.
4,214,754 A 7/1980 Zebelean
D256,709 S 9/1980 Reid, Jr. et al.
4,247,105 A 1/1981 Jeghers
4,253,666 A 3/1981 Murphy
4,262,562 A 4/1981 MacNeill
D259,698 S 6/1981 MacNeill
4,306,721 A 12/1981 Doyle
D265,112 S 6/1982 Lyons
4,340,227 A 7/1982 Dopkowski
4,340,229 A 7/1982 Stuff, Jr.
4,398,965 A 8/1983 Campau
4,411,430 A 10/1983 Dian
4,423,874 A 1/1984 Stuff, Jr.
4,431,192 A 2/1984 Stuff, Jr.
4,432,549 A 2/1984 Zebelean
4,438,931 A 3/1984 Motomiya
4,471,961 A 9/1984 Masghati et al.
4,498,673 A 2/1985 Swanson
4,506,888 A 3/1985 Nardozzi, Jr.
4,527,799 A 7/1985 Solheim
4,530,505 A 7/1985 Stuff
4,545,580 A 10/1985 Tomita et al.
D284,346 S 6/1986 Masters
4,592,552 A 6/1986 Garber
4,602,787 A 7/1986 Sugioka et al.
4,607,846 A 8/1986 Perkins
4,618,149 A 10/1986 Maxel
4,630,826 A 12/1986 Nishigaki et al.
4,664,382 A 5/1987 Palmer et al.
4,712,798 A 12/1987 Preato
4,730,830 A 3/1988 Tilley
4,736,093 A 4/1988 Braly
4,740,345 A 4/1988 Nagasaki et al.
4,754,974 A 7/1988 Kobayashi
4,754,977 A 7/1988 Sahm
4,787,636 A 11/1988 Honma
4,792,139 A 12/1988 Nagasaki et al.
4,793,616 A 12/1988 Fernandez
4,795,159 A 1/1989 Nagamoto
4,798,383 A 1/1989 Nagasaki et al.
4,809,978 A 3/1989 Yamaguchi et al.
4,848,747 A 7/1989 Fujimura et al.
4,852,782 A 8/1989 Wu et al.
4,854,582 A 8/1989 Yamada
4,867,457 A 9/1989 Lowe
4,867,458 A 9/1989 Sumikawa et al.
4,869,507 A 9/1989 Sahm
4,881,739 A 11/1989 Garcia
4,884,812 A 12/1989 Nagasaki et al.
4,895,367 A 1/1990 Kajita et al.
4,895,368 A 1/1990 Geiger
4,895,371 A 1/1990 Bushner
4,900,379 A 2/1990 Chapman
4,919,428 A 4/1990 Perkins
4,928,972 A 5/1990 Nakanishi et al.
4,943,059 A 7/1990 Morell
4,948,132 A 8/1990 Wharton
4,962,932 A 10/1990 Anderson
4,964,640 A 10/1990 Nakanishi et al.
4,994,515 A 2/1991 Washiyama et al.
4,995,609 A 2/1991 Parente et al.
5,000,454 A 3/1991 Soda
5,016,882 A 5/1991 Fujimura et al.
5,039,098 A 8/1991 Pelz
5,039,267 A 8/1991 Wollar
5,050,879 A 9/1991 Sun et al.
5,054,784 A 10/1991 Collins
5,058,895 A 10/1991 Igarashi
5,078,397 A 1/1992 Aizawa
5,092,599 A 3/1992 Okumoto et al.

(56) References Cited

U.S. PATENT DOCUMENTS 5,116,054 A 5/1992 Johnson
5,133,553 A 7/1992 Divnick
5,176,384 A 1/1993 Sata et al.
5,178,394 A 1/1993 Tanampai
5,190,289 A 3/1993 Nagai et al.
5,193,810 A 3/1993 Antonious
5,221,086 A 6/1993 Antonious
5,244,210 A 9/1993 Au
5,253,869 A 10/1993 Dingle et al.
5,255,914 A 10/1993 Schroder
5,255,919 A 10/1993 Johnson
5,271,621 A 12/1993 Lo
D343,558 S 1/1994 Latraverse et al.
5,275,408 A 1/1994 Desbiolles et al.
5,280,923 A 1/1994 Lu
5,301,944 A 4/1994 Koehler
5,310,185 A 5/1994 Viollaz et al.
5,312,106 A 5/1994 Cook
5,316,305 A 5/1994 McCabe
5,318,297 A 6/1994 Davis et al.
5,320,005 A 6/1994 Hsiao
5,328,176 A 7/1994 Lo
D349,543 S 8/1994 MacDougall
5,340,106 A 8/1994 Ravaris
5,346,216 A 9/1994 Aizawa
5,377,986 A 1/1995 Viollaz et al.
5,385,348 A 1/1995 Wargo
5,410,798 A 5/1995 Lo
5,417,419 A 5/1995 Anderson et al.
5,421,577 A 6/1995 Kobayashi
5,425,538 A 6/1995 Vincent et al.
5,429,365 A 7/1995 McKeighen
5,431,396 A 7/1995 Shieh
5,433,422 A 7/1995 Walker
5,435,558 A 7/1995 Iriarte
5,439,222 A 8/1995 Kranenberg
5,441,274 A 8/1995 Clay
5,447,309 A 9/1995 Vincent
5,447,311 A 9/1995 Viollaz et al.
D365,615 S 12/1995 Shimatani
5,472,201 A 12/1995 Aizawa et al.
5,482,280 A * 1/1996 Yamawaki ..... A63B 53/00 473/290
5,511,786 A 4/1996 Antonious
5,513,844 A 5/1996 Ashcraft et al.
5,518,243 A * 5/1996 Redman ..... A63B 53/04 473/334
5,524,331 A 6/1996 Pond
5,533,725 A 7/1996 Reynolds, Jr.
5,533,730 A 7/1996 Ruvang
5,540,435 A 7/1996 Kawasaki
5,542,666 A 8/1996 Chou
5,558,332 A 9/1996 Cook
D375,130 S 10/1996 Hlinka et al.
5,571,053 A 11/1996 Lane
5,588,921 A 12/1996 Parsick
D378,770 S 4/1997 Hlinka et al.
5,620,379 A 4/1997 Borys
5,624,331 A 4/1997 Lo et al.
5,626,528 A 5/1997 Toulon
5,629,475 A 5/1997 Chastonay
5,632,694 A 5/1997 Lee
5,632,695 A 5/1997 Hlinka et al.
5,653,645 A 8/1997 Baumann
5,669,827 A 9/1997 Nagamoto
5,672,120 A 9/1997 Ramirez et al.
5,683,309 A 11/1997 Reimers
5,688,188 A 11/1997 Chappell
5,695,412 A 12/1997 Cook
5,700,208 A 12/1997 Nelms
5,702,310 A 12/1997 Wozny
5,709,613 A 1/1998 Sheraw
5,718,641 A 2/1998 Lin
D392,526 S 3/1998 Nicely
5,722,901 A 3/1998 Barron et al.
5,743,813 A 4/1998 Chen et al.
5,746,553 A 5/1998 Engwall
5,746,664 A 5/1998 Reynolds, Jr.
5,749,790 A 5/1998 Van Alen, II et al.
5,755,627 A 5/1998 Yamazaki et al.
5,759,114 A 6/1998 Bluto et al.
5,766,094 A 6/1998 Mahaffey et al.
5,769,737 A 6/1998 Holladay et al.
5,776,011 A 7/1998 Su et al.
5,785,608 A 7/1998 Collins
5,797,807 A 8/1998 Moore
5,807,186 A 9/1998 Chen
RE35,931 E 10/1998 Schroder et al.
5,827,131 A 10/1998 Mahaffey et al.
RE35,955 E 11/1998 Lu
D401,650 S 11/1998 Burrows
5,839,973 A 11/1998 Jackson
5,851,155 A 12/1998 Wood et al.
5,851,160 A 12/1998 Rugge et al.
5,863,260 A 1/1999 Butler, Jr. et al.
5,876,293 A 3/1999 Musty
5,885,166 A 3/1999 Shiraishi
5,890,971 A 4/1999 Shiraishi
D409,463 S 5/1999 McMullin
5,906,549 A 5/1999 Kubica
5,908,356 A 6/1999 Nagamoto
5,911,638 A 6/1999 Parente et al.
D412,547 S 8/1999 Fong
5,931,742 A 8/1999 Nishimura et al.
5,935,019 A 8/1999 Yamamoto
5,935,020 A 8/1999 Stites et al.
5,941,782 A 8/1999 Cook
5,947,840 A 9/1999 Ryan
5,951,411 A 9/1999 Wood et al.
5,954,595 A 9/1999 Antonious
5,967,903 A 10/1999 Cheng
5,967,905 A 10/1999 Nakahara et al.
5,985,197 A 11/1999 Nelson et al.
5,997,415 A 12/1999 Wood
6,001,029 A 12/1999 Kobayashi
6,015,354 A 1/2000 Ahn et al.
6,019,686 A 2/2000 Gray
6,023,891 A 2/2000 Robertson et al.
6,032,677 A 3/2000 Blechman et al.
6,033,319 A 3/2000 Farrar
6,039,659 A 3/2000 Hamm
6,056,649 A 5/2000 Imai
6,071,200 A 6/2000 Song
6,074,308 A 6/2000 Domas
6,083,115 A 7/2000 King
6,089,994 A 7/2000 Sun
6,093,113 A 7/2000 Mertens
6,110,055 A 8/2000 Wilson
6,120,384 A 9/2000 Drake
6,123,627 A 9/2000 Antonious
6,139,445 A 10/2000 Werner et al.
6,149,533 A 11/2000 Finn
6,152,833 A 11/2000 Werner et al.
6,162,133 A 12/2000 Peterson
6,165,081 A 12/2000 Chou
6,168,537 B1 * 1/2001 Ezawa ..... A63B 53/04 473/327
6,193,614 B1 2/2001 Sasamoto et al.
6,238,303 B1 5/2001 Fite
6,244,974 B1 6/2001 Hanberry, Jr.
6,248,024 B1 6/2001 Nelson et al.
6,248,025 B1 6/2001 Murphy et al.
6,251,028 B1 6/2001 Jackson
6,254,494 B1 * 7/2001 Hasebe ..... A63B 53/04 473/349
6,270,422 B1 8/2001 Fisher
6,270,425 B1 8/2001 Dyer
6,273,828 B1 8/2001 Wood et al.
6,277,032 B1 8/2001 Smith
6,287,214 B1 9/2001 Satoh
6,296,579 B1 10/2001 Robinson
6,299,547 B1 10/2001 Kosmatka
6,319,150 B1 11/2001 Werner et al.
6,334,817 B1 1/2002 Ezawa et al.

(56) References Cited

U.S. PATENT DOCUMENTS 6,338,683 B1 1/2002 Kosmatka
6,344,002 B1 2/2002 Kajita
6,348,014 B1 2/2002 Chiu
6,352,483 B1 3/2002 Okoshi
6,354,962 B1 3/2002 Galloway et al.
6,364,789 B1 4/2002 Kosmatka
6,368,230 B1 4/2002 Helmstetter et al.
6,368,234 B1 4/2002 Galloway
6,371,865 B1 4/2002 Magliulo
6,371,866 B1 4/2002 Rivera
6,383,090 B1 5/2002 O'Doherty et al.
6,390,933 B1 5/2002 Galloway
6,402,639 B1 6/2002 Iwata et al.
6,406,378 B1 6/2002 Murphy et al.
6,406,381 B2 6/2002 Murphy et al.
6,409,612 B1 6/2002 Evans et al.
6,425,832 B2 7/2002 Cackett et al.
6,428,427 B1 8/2002 Kosmatka
6,435,980 B1 8/2002 Reyes et al.
6,436,142 B1 8/2002 Paes et al.
6,440,008 B2 8/2002 Murphy et al.
6,440,009 B1 8/2002 Guibaud et al.
6,447,404 B1 9/2002 Wilbur
6,458,042 B1 10/2002 Chen
6,464,598 B1 10/2002 Miller
6,471,604 B2 10/2002 Hocknell et al.
6,475,100 B1 11/2002 Helmstetter et al.
6,478,691 B2 11/2002 Okoshi
6,491,592 B2 12/2002 Cackett et al.
6,514,154 B1 2/2003 Finn
6,524,197 B2 2/2003 Boone
6,527,649 B1 3/2003 Neher et al.
6,530,847 B1 3/2003 Antonious
6,530,848 B2 3/2003 Gillig
6,547,673 B2 4/2003 Roark
6,547,676 B2 4/2003 Cackett et al.
6,565,448 B2 5/2003 Cameron et al.
6,565,452 B2 5/2003 Helmstetter et al.
6,569,040 B2 5/2003 Bradstock
6,572,489 B2 6/2003 Miyamoto et al.
6,575,843 B2 6/2003 McCabe
6,575,845 B2 6/2003 Galloway et al.
6,582,323 B2 6/2003 Soracco et al.
6,602,149 B1 8/2003 Jacobson
6,605,007 B1 8/2003 Bissonnette et al.
6,607,452 B2 8/2003 Helmstetter et al.
6,612,938 B2 9/2003 Murphy et al.
6,620,053 B2 9/2003 Tseng
6,634,957 B2 10/2003 Tseng
D482,420 S 11/2003 Burrows
6,641,487 B1 11/2003 Hamburger
6,648,773 B1 11/2003 Evans
6,669,571 B1 12/2003 Cameron et al.
6,669,573 B2 12/2003 Wood et al.
6,669,577 B1 12/2003 Hocknell et al.
6,669,578 B1 12/2003 Evans
6,669,580 B1 12/2003 Cackett et al.
6,676,536 B1 1/2004 Jacobson
6,723,002 B1 4/2004 Barlow
6,723,007 B1 4/2004 Chao
6,739,982 B2 5/2004 Murphy et al.
6,739,983 B2 5/2004 Helmstetter et al.
6,743,118 B1 6/2004 Soracco
6,746,341 B1 6/2004 Hamric, Jr. et al.
6,757,572 B1 6/2004 Forest
6,758,763 B2 7/2004 Murphy et al.
6,764,413 B2 7/2004 Ho
6,769,994 B2 8/2004 Boone
6,769,996 B2 8/2004 Tseng
6,773,359 B1 8/2004 Lee
6,773,360 B2 8/2004 Willett et al.
6,776,723 B2 8/2004 Bliss et al.
RE38,605 E 9/2004 Kubica et al.
6,789,304 B2 9/2004 Kouno
6,800,038 B2 10/2004 Willett et al.
6,824,475 B2 11/2004 Burnett et al.
D501,903 S 2/2005 Tanaka
6,849,002 B2 2/2005 Rice
6,855,068 B2 2/2005 Antonious
6,857,969 B2 2/2005 Rice
6,860,818 B2 3/2005 Mahaffey et al.
6,860,823 B2 3/2005 Lee
6,860,824 B2 3/2005 Evans
6,875,129 B2 4/2005 Erickson et al.
6,881,159 B2 4/2005 Galloway et al.
6,890,269 B2 5/2005 Burrows
6,899,636 B2 5/2005 Finn
6,904,663 B2 6/2005 Willett et al.
6,926,616 B1 8/2005 Kusumoto et al.
6,926,619 B2 8/2005 Helmstetter et al.
6,939,247 B1 * 9/2005 Schweigert ..... A63B 53/0466 473/314
6,955,612 B2 10/2005 Lu
6,960,142 B2 11/2005 Bissonnette et al.
6,964,617 B2 11/2005 Williams
6,966,847 B2 11/2005 Lenhof et al.
6,974,393 B2 12/2005 Caldwell et al.
6,988,960 B2 1/2006 Mahaffey et al.
6,991,558 B2 1/2006 Beach et al.
D515,643 S 2/2006 Ortiz
6,997,818 B2 2/2006 Kouno
6,997,820 B2 2/2006 Willett et al.
7,004,849 B2 2/2006 Cameron
7,004,852 B2 2/2006 Billings
7,014,569 B1 3/2006 Figgers
7,025,692 B2 4/2006 Erickson et al.
7,025,695 B2 4/2006 Mitsuba
7,029,403 B2 4/2006 Rice et al.
D522,601 S 6/2006 Schweigert
7,066,832 B2 6/2006 Willett et al.
7,082,665 B2 8/2006 Deshmukh et al.
7,083,529 B2 8/2006 Cackett et al.
7,115,046 B1 10/2006 Evans
7,140,974 B2 11/2006 Chao et al.
7,153,220 B2 12/2006 Lo
7,163,468 B2 1/2007 Gibbs et al.
7,163,470 B2 1/2007 Galloway et al.
7,166,038 B2 1/2007 Williams et al.
7,166,040 B2 1/2007 Hoffman et al.
7,169,058 B1 1/2007 Fagan
7,169,060 B2 1/2007 Stevens et al.
D537,495 S 2/2007 Schweigert
7,186,190 B1 3/2007 Beach et al.
7,189,165 B2 3/2007 Yamamoto
7,189,169 B2 3/2007 Billings
7,198,575 B2 4/2007 Beach et al.
D543,600 S 5/2007 Oldknow
7,214,143 B2 5/2007 Deshmukh
7,223,180 B2 5/2007 Willett et al.
D544,939 S 6/2007 Radcliffe et al.
7,241,229 B2 7/2007 Poynoŕ
D549,792 S 8/2007 Parise
7,252,600 B2 8/2007 Murphy et al.
7,255,654 B2 8/2007 Murphy et al.
7,267,620 B2 9/2007 Chao et al.
D552,198 S 10/2007 Schweigert
7,278,927 B2 10/2007 Gibbs et al.
D554,720 S 11/2007 Barez et al.
7,294,064 B2 11/2007 Tsurumaki et al.
7,300,359 B2 11/2007 Hocknell et al.
7,326,126 B2 2/2008 Holt et al.
7,335,113 B2 2/2008 Hocknell et al.
D564,611 S 3/2008 Llewellyn
7,344,449 B2 3/2008 Hocknell et al.
7,367,899 B2 5/2008 Rice et al.
7,390,266 B2 6/2008 Gwon
7,402,112 B2 7/2008 Galloway
7,427,239 B2 9/2008 Hocknell et al.
7,448,963 B2 11/2008 Beach et al.
7,465,239 B2 12/2008 Hocknell et al.
7,476,160 B2 1/2009 Hocknell et al.
7,491,136 B2 2/2009 Deng et al.
D588,661 S 3/2009 Lee
D588,662 S 3/2009 Lee

(56) References Cited

U.S. PATENT DOCUMENTS

D588,663 S 3/2009 Lee
D588,664 S 3/2009 Lee
D589,103 S 3/2009 Kohno
7,628,712 B2 12/2009 Chao et al.
7,674,187 B2 3/2010 Cackett et al.
7,674,189 B2 3/2010 Beach et al.
7,699,717 B2 4/2010 Morris et al.
7,731,603 B2 6/2010 Beach et al.
D622,338 S 8/2010 Kohno
D622,795 S 8/2010 Furutate
7,766,765 B2 8/2010 Oyama
7,771,291 B1 8/2010 Willett et al.
7,874,936 B2 1/2011 Chao
7,887,431 B2 2/2011 Beach et al.
7,927,229 B2 4/2011 Jertson et al.
8,012,038 B1 * 9/2011 Beach ..... A63B 53/0466 473/329
8,012,039 B2 9/2011 Greaney et al.
8,083,609 B2 12/2011 Burnett et al.
8,088,021 B2 1/2012 Albertsen et al.
8,133,135 B2 3/2012 Stites et al.
8,187,115 B2 5/2012 Bennett et al.
D686,679 S 7/2013 Greensmith et al.
8,496,544 B2 7/2013 Curtis et al.
8,523,705 B2 9/2013 Breier et al.
8,529,368 B2 9/2013 Rice et al.
D692,077 S 10/2013 Greensmith et al.
D696,366 S 12/2013 Milo et al.
D696,367 S 12/2013 Taylor et al.
D697,152 S 1/2014 Harbert et al.
8,663,029 B2 3/2014 Beach et al.
8,858,359 B2 10/2014 Willett et al.
9,044,653 B2 6/2015 Wahl et al.
2001/0007835 A1 7/2001 Baron
2001/0049310 A1 12/2001 Cheng et al.
2002/0022535 A1 2/2002 Takeda
2002/0037773 A1 3/2002 Wood et al.
2002/0049095 A1 4/2002 Galloway et al.
2002/0072434 A1 6/2002 Yabu
2002/0082115 A1 6/2002 Reyes et al.
2002/0137576 A1 9/2002 Dammen
2002/0160854 A1 10/2002 Beach et al.
2002/0169034 A1 11/2002 Hocknell et al.
2002/0183130 A1 12/2002 Pacinella
2002/0183134 A1 12/2002 Allen et al.
2002/0187852 A1 12/2002 Kosmatka
2003/0008723 A1 1/2003 Goodman
2003/0013542 A1 1/2003 Burnett et al.
2003/0114239 A1 6/2003 Mase
2003/0130059 A1 7/2003 Billings
2003/0220154 A1 11/2003 Anelli
2004/0018886 A1 1/2004 Burrows
2004/0018887 A1 1/2004 Burrows
2004/0063515 A1 4/2004 Boone
2004/0087388 A1 5/2004 Beach et al.
2004/0157678 A1 8/2004 Kohno
2004/0162156 A1 8/2004 Kohno
2004/0192463 A1 9/2004 Tsurumaki et al.
2004/0235584 A1 11/2004 Chao et al.
2004/0242343 A1 12/2004 Chao
2005/0003903 A1 * 1/2005 Galloway ..... A63B 53/02 473/342
2005/0009622 A1 1/2005 Antonious
2005/0020382 A1 * 1/2005 Yamagishi ..... A63B 53/0466 473/345
2005/0049067 A1 3/2005 Hsu
2005/0049072 A1 3/2005 Burrows
2005/0059508 A1 3/2005 Burnett et al.
2005/0079923 A1 4/2005 Droppleman
2005/0085315 A1 4/2005 Wahl et al.
2005/0239575 A1 10/2005 Chao et al.
2006/0009305 A1 1/2006 Lindsay
2006/0058112 A1 3/2006 Haralason et al.
2006/0094535 A1 5/2006 Cameron
2006/0116218 A1 6/2006 Burnett et al.
2006/0154747 A1 7/2006 Beach et al.
2006/0258481 A1 * 11/2006 Oyama ..... A63B 53/0466 473/345
2006/0281581 A1 12/2006 Yamamoto
2006/0287125 A1 12/2006 Hocknell et al.
2007/0099719 A1 5/2007 Halleck et al.
2007/0105647 A1 5/2007 Beach et al.
2007/0105648 A1 5/2007 Beach et al.
2007/0105649 A1 5/2007 Beach et al.
2007/0105650 A1 5/2007 Beach et al.
2007/0105651 A1 5/2007 Beach et al.
2007/0105652 A1 5/2007 Beach et al.
2007/0105653 A1 5/2007 Beach et al.
2007/0105654 A1 5/2007 Beach et al.
2007/0105655 A1 5/2007 Beach et al.
2007/0105657 A1 5/2007 Hirano
2007/0117645 A1 5/2007 Nakashima
2007/0219016 A1 * 9/2007 Deshmukh ..... A63B 53/0466 473/342
2007/0254746 A1 11/2007 Poynor
2007/0265106 A1 11/2007 Burrows
2007/0275792 A1 11/2007 Horacek et al.
2008/0039234 A1 2/2008 Williams et al.
2008/0058114 A1 3/2008 Hocknell et al.
2008/0076590 A1 3/2008 Hsu
2008/0119301 A1 5/2008 Holt et al.
2008/0132356 A1 * 6/2008 Chao ..... A63B 53/0466 473/350
2008/0139334 A1 6/2008 Willett et al.
2008/0146374 A1 6/2008 Beach et al.
2008/0254908 A1 10/2008 Bennett et al.
2008/0261717 A1 10/2008 Hoffman et al.
2008/0280693 A1 11/2008 Chai
2008/0280698 A1 11/2008 Hoffman et al.
2008/0300068 A1 12/2008 Chao
2009/0011848 A1 1/2009 Thomas et al.
2009/0011849 A1 1/2009 Thomas et al.
2009/0011850 A1 1/2009 Stites et al.
2009/0062029 A1 3/2009 Stites et al.
2009/0118034 A1 5/2009 Yokota
2009/0124411 A1 5/2009 Rae et al.
2009/0137338 A1 5/2009 Kajita
2009/0143167 A1 6/2009 Evans
2009/0149275 A1 6/2009 Rae et al.
2009/0163289 A1 6/2009 Chao
2009/0163291 A1 6/2009 Chao
2009/0163296 A1 6/2009 Chao
2009/0170632 A1 7/2009 Beach et al.
2009/0191980 A1 7/2009 Greaney et al.
2009/0221381 A1 9/2009 Breier et al.
2009/0239677 A1 9/2009 DeShiell et al.
2010/0016095 A1 * 1/2010 Burnett ..... A63B 53/0466 473/327
2010/0016097 A1 1/2010 Albertsen et al.
2011/0014992 A1 1/2011 Morrissey
2011/0152000 A1 6/2011 Sargent et al.
2011/0250986 A1 10/2011 Schweigert
2012/0071267 A1 3/2012 Burnett et al.
2012/0071268 A1 3/2012 Albertsen et al.
2012/0077616 A1 3/2012 Stites
2012/0172146 A1 7/2012 Greaney
2012/0202615 A1 * 8/2012 Beach ..... A63B 53/0466 473/338
2012/0289361 A1 11/2012 Beach
2012/0316007 A1 12/2012 Burnett et al.
2013/0059678 A1 * 3/2013 Stites ..... A63B 53/0466 473/345
2013/0116062 A1 * 5/2013 Zimmerman ..... A63B 53/02 473/307
2013/0123040 A1 5/2013 Willett et al.
2013/0172103 A1 7/2013 Greensmith et al.
2014/0256461 A1 9/2014 Beach et al.
2014/0274457 A1 9/2014 Beach et al.
2014/0274464 A1 9/2014 Schweigert et al.
2015/0148149 A1 5/2015 Beach et al.
2019/0262671 A1 8/2019 Beach et al.

(56) References Cited

U.S. PATENT DOCUMENTS

FOREIGN PATENT DOCUMENTS

| | | |
|---|---|---|
| EP | 1001175 | 5/2000 |
| EP | 1172189 | 1/2002 |
| GB | 194823 | 12/1921 |
| GB | 1201648 | 8/1970 |
| GB | 2207358 | 2/1989 |
| GB | 2225725 | 6/1990 |
| GB | 2241173 | 8/1991 |
| GB | 2268412 | 1/1994 |
| JP | 60-15145 | 1/1985 |
| JP | 01314583 | 12/1989 |
| JP | 01314779 | 12/1989 |
| JP | 02005979 | 1/1990 |
| JP | 02191475 | 7/1990 |
| JP | 4156869 | 5/1992 |
| JP | 05076628 | 3/1993 |
| JP | 05237207 | 9/1993 |
| JP | 05-317465 | 12/1993 |
| JP | 06007485 | 1/1994 |
| JP | 06015016 | 1/1994 |
| JP | 6-23071 | 2/1994 |
| JP | 06-126004 | 5/1994 |
| JP | 06-165842 | 6/1994 |
| JP | 6-205858 | 7/1994 |
| JP | H06190088 | 7/1994 |
| JP | 6-304271 | 11/1994 |
| JP | 08071187 | 3/1996 |
| JP | 08215354 | 8/1996 |
| JP | 08280855 | 10/1996 |
| JP | 8318008 | 12/1996 |
| JP | 09-028844 | 2/1997 |
| JP | 9164227 | 6/1997 |
| JP | 09-176347 | 7/1997 |
| JP | 09-308717 | 12/1997 |
| JP | 09-327534 | 12/1997 |
| JP | 10-234902 | 9/1998 |
| JP | 10-277187 | 10/1998 |
| JP | H10263118 | 10/1998 |
| JP | H11114102 | 4/1999 |
| JP | 11-137734 | 5/1999 |
| JP | H11155982 | 6/1999 |
| JP | 11290488 | 10/1999 |
| JP | 2000005349 | 1/2000 |
| JP | 2001062652 | 3/2001 |
| JP | 2001276285 | 10/2001 |
| JP | 2002-052099 | 2/2002 |
| JP | 2002136625 | 5/2002 |
| JP | 2003-062131 | 3/2003 |
| JP | 2003135632 | 5/2003 |
| JP | 2003210621 | 7/2003 |
| JP | 2003524487 | 8/2003 |
| JP | 2003320061 | 11/2003 |
| JP | 2004174224 | 6/2004 |
| JP | 2004222911 | 8/2004 |
| JP | 2004232397 | 8/2004 |
| JP | 2004261451 | 9/2004 |
| JP | 2004265992 | 9/2004 |
| JP | 2004267438 | 9/2004 |
| JP | 2004271516 | 9/2004 |
| JP | 2004313762 | 11/2004 |
| JP | 2004329544 | 11/2004 |
| JP | 2004-351173 | 12/2004 |
| JP | 2004344664 | 12/2004 |
| JP | 2004351054 | 12/2004 |
| JP | 2005073736 | 3/2005 |
| JP | 2005111172 | 4/2005 |
| JP | 2005137494 | 6/2005 |
| JP | 2005137788 | 6/2005 |
| JP | 2006-042951 | 2/2006 |
| JP | 2006034906 | 2/2006 |
| JP | 4177414 | 8/2008 |
| JP | 2008194495 | 8/2008 |
| JP | 2008272274 | 11/2008 |
| JP | 2008272496 | 11/2008 |
| JP | 2009112800 | 5/2009 |
| JP | 2009136608 | 6/2009 |
| TW | 139608 | 8/1990 |
| WO | WO88/02642 | 4/1988 |
| WO | WO93/00968 | 1/1993 |
| WO | WO01/66199 | 9/2001 |
| WO | WO02/062501 | 8/2002 |
| WO | WO03/061773 | 7/2003 |
| WO | WO2004/009186 | 1/2004 |
| WO | WO2004/065083 | 8/2004 |
| WO | WO2005/009543 | 2/2005 |
| WO | WO2005/028038 | 3/2005 |
| WO | WO2006/018929 | 2/2006 |
| WO | WO2006/055386 | 5/2006 |

OTHER PUBLICATIONS

Callaway Golf, World's Straightest Driver: FT-i Driver downloaded from www.callawaygolf.com/ft%2Di/driver.aspx?lang=en on Apr. 5, 2007.

Ellis, Jeffrey B., *The Clubmaker's Art: Antique Golf Clubs and Their History, Second Edition Revised and Expanded*, vol. II, 2007, p. 485.

International Searching Authority (USPTO), International Search Report and Written Opinion for International Application No. PCT/US 09/49742, dated Aug. 27, 2009, 11 pages.

International Searching Authority (USPTO), International Search Report and Written Opinion for International Application No. PCT/US2009/049418, dated Aug. 26, 2009, 10 pages.

"Invalidity Search Report for Japanese Registered Patent No. 4128970," 4 pp. (dated Nov. 29, 2013).

Jackson, Jeff, The Modern Guide to Golf Clubmaking, Ohio: Dynacraft Golf Products, Inc., copyright 1994, p. 237.

"Mickey Finn T-Bar Putter—The Mickey Finn Golf Putter," Oct. 20, 2004 (http://www.mickeyfinngolf.com/Default/asp) (1 page).

"Charles A. "Mickey" Finn, Mickey Finn Tom Clancy the Cardinal of the Kremlin," Oct. 20, 2004 (http://www.mickeyfinngolf.com/mickeyfinngolf.asp) (2 pages).

"Mickey Finn M-2 T-Bar Putter & Mickey Finn M-3 T-Bar Putter," Oct. 20, 2004 (http://www.mickeyfinngolf.com/putters.asp) (3 pages).

Nike Golf, Sasquatch 460, downloaded from www.nike.com/nikegolf/index.htm on Apr. 5, 2007.

Nike Golf, Sasquatch Sumo Squared Driver, downloaded from www.nike.com/nikegolf/index.htm on Apr. 5, 2007.

Taylor Made '94/'95 Products—Mid Tour; Mid Tour GF (1 page).

Taylor Made Golf Company Inc., R7 460 Drivers, downloaded from www.taylormadegolf.com/product_detail.asp?pID=14section=overview on Apr. 5, 2007.

Titleist 907D1, downloaded from www.tees2greens.com/forum/Uploads/Images/7ade3521-192b-4611-870b-395d.jpg on Feb. 1, 2007.

* cited by examiner

GOLF CLUB

CROSS-REFERENCE TO RELATED APPLICATIONS

This application is a continuation of U.S. patent application Ser. No. 15/838,682, filed Dec. 12, 2017, entitled "GOLF CLUB," which is a continuation of U.S. patent application Ser. No. 14/144,105, filed Dec. 30, 2013, now U.S. Pat. No. 9,861,864, issued Jan. 9, 2018, entitled "GOLF CLUB," which claims priority to U.S. Provisional Application No. 61/909,964, entitled "GOLF CLUB," filed Nov. 27, 2013, both of which are hereby specifically incorporated by reference herein in their entirety. This application references U.S. patent application Ser. No. 13/839,727, entitled "GOLF CLUB WITH COEFFICIENT OF RESTITUTION FEATURE," filed Mar. 15, 2013, which is incorporated by reference herein in its entirety and with specific reference to discussion of center of gravity location and the resulting effects on club performance. This application also references U.S. Pat. No. 7,731,603, entitled "GOLF CLUB HEAD," filed Sep. 27, 2007, which is incorporated by reference herein in its entirety and with specific reference to discussion of moment of inertia. This application also references U.S. Pat. No. 7,887,431, entitled "GOLF CLUB," filed Dec. 30, 2008, which is incorporated by reference herein in its entirety and with specific reference to discussion of adjustable loft technology described therein. This application also references Application for U.S. Patent bearing Ser. No. 13/718,107, entitled "HIGH VOLUME AERODYNAMIC GOLF CLUB HEAD," filed Dec. 18, 2012, which is incorporated by reference herein in its entirety and with specific reference to discussion of aerodynamic golf club heads. This application also references U.S. Pat. No. 7,874,936, entitled "COMPOSITE ARTICLES AND METHODS FOR MAKING THE SAME," filed Dec. 19, 2007, which is incorporated by reference herein in its entirety and with specific reference to discussion of composite face technology.

FIELD

This disclosure relates to wood-type golf clubs. Particularly, this disclosure relates to wood-type golf club heads with low center of gravity.

BACKGROUND

As described with reference to U.S. patent application Ser. No. 13/839,727, entitled "GOLF CLUB WITH COEFFICIENT OF RESTITUTION FEATURE," filed Mar. 15, 2013—incorporated by reference herein—there is benefit associated with locating the center of gravity (CG) of the golf club head proximal to the face and low in the golf club head. In certain types of heads, it may still be the most desirable design to locate the CG of the golf club head as low as possible regardless of its location within the golf club head. However, in many situations, a low and forward CG location may provide some benefits not seen in prior designs or in comparable designs without a low and forward CG.

For reference, within this disclosure, reference to a "fairway wood type golf club head" means any wood type golf club head intended to be used with or without a tee. For reference, "driver type golf club head" means any wood type golf club head intended to be used primarily with a tee. In general, fairway wood type golf club heads have lofts of 13 degrees or greater, and, more usually, 15 degrees or greater. In general, driver type golf club heads have lofts of 12 degrees or less, and, more usually, of 10.5 degrees or less. In general, fairway wood type golf club heads have a length from leading edge to trailing edge of 73-97 mm. Various definitions distinguish a fairway wood type golf club head from a hybrid type golf club head, which tends to resemble a fairway wood type golf club head but be of smaller length from leading edge to trailing edge. In general, hybrid type golf club heads are 38-73 mm in length from leading edge to trailing edge. Hybrid type golf club heads may also be distinguished from fairway wood type golf club heads by weight, by lie angle, by volume, and/or by shaft length. Fairway wood type golf club heads of the current disclosure are 16 degrees of loft. In various embodiments, fairway wood type golf club heads of the current disclosure may be from 15-19.5 degrees. In various embodiments, fairway wood type golf club heads of the current disclosure may be from 13-17 degrees. In various embodiments, fairway wood type golf club heads of the current disclosure may be from 13-19.5 degrees. In various embodiments, fairway wood type golf club heads of the current disclosure may be from 13-26 degrees. Driver type golf club heads of the current disclosure may be 12 degrees or less in various embodiments or 10.5 degrees or less in various embodiments.

SUMMARY

A golf club head includes a club body including a crown, a sole, a skirt disposed between and connecting the crown and the sole and a face portion connected to a front end of the club body. The face portion includes a geometric center defining the origin of a coordinate system when the golf club head is ideally positioned, the coordinate system including an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis. The golf club head defines a center of gravity CG, the CG being a distance $CG_Y$ from the origin as measured along the y-axis and a distance $CG_Z$ from the origin as measured along the z-axis.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1A:
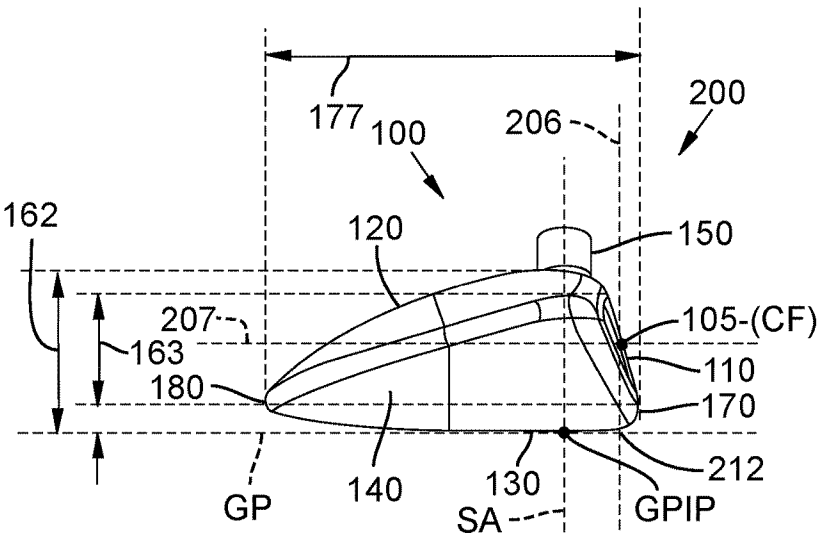
FIG. 1A is a toe side view of a golf club head for reference.

Disclosed is a golf club and a golf club head as well as associated methods, systems, devices, and various apparatus. It would be understood by one of skill in the art that the disclosed golf club heads are described in but a few exemplary embodiments among many. No particular terminology or description should be considered limiting on the disclosure or the scope of any claims issuing therefrom.

Low and forward center of gravity in a wood-type golf club head is advantageous for any of a variety of reasons. The combination of high launch and low spin is particularly desirable from wood-type golf club heads. Low and forward center of gravity location in wood-type golf club heads aids in achieving the ideal launch conditions by reducing spin and increasing launch angle. In certain situations, however, low and forward center of gravity can reduce the moment of inertia of a golf club head if a substantial portion of the mass is concentrated in one region of the golf club head. As described in U.S. Pat. No. 7,731,603, filed Sep. 27, 2007, entitled "GOLF CLUB HEAD," increasing moment of inertia can be beneficial to improve stability of the golf club head for off-center contact. For example, when a substantial portion of the mass of the golf club head is located low and forward, the center of gravity of the golf club head can be moved substantially. However, moment of inertia is a function of mass and the square of the distance from the mass to the axis about which the moment of inertia is measured. As the distance between the mass and the axis of the moment of inertia changes, the moment of inertia of the body changes quadratically. However, as mass becomes concentrated in one location, it is more likely that the center of gravity approaches that localized mass. As such, golf club heads with mass concentrated in one area can have particularly low moments of inertia in some cases.

Particularly low moments of inertia can be detrimental in some cases. Especially with respect to poor strikes and/or off-center strikes, low moment of inertia of the golf club head can lead to twisting of the golf club head. With respect to moment of inertia along an axis passing through the center of gravity, parallel to the ground, and parallel to a line that would be tangent to the face (hereinafter the "center of gravity x-axis"), low moment of inertia can change flight properties for off-center strikes. In the current discussion, when the center of gravity is particularly low and forward in the golf club head, strikes that are substantially above the center of gravity lead to a relatively large moment arm and potential for twisting. If the moment of inertia of the golf club head about the center of gravity x-axis (hereinafter the "$I_{xx}$") is particularly low, high twisting can result in energy being lost in twisting rather than being transferred to the golf ball to create distance. As such, although low and forward center of gravity is beneficial for creating better launch conditions, poor implementation may result in a particularly unforgiving golf club head in certain circumstances.

A low and forward center of gravity location in the golf club head results in favorable flight conditions because the low and forward center of gravity location results in a projection of the center of gravity normal to a tangent face plane (see discussion of tangent face plane and center of gravity projection as described in U.S. patent application Ser. No. 13/839,727, entitled "Golf Club," filed Mar. 15, 2013, which is incorporated herein by reference in its entirety). During impact with the ball, the center of gravity projection determines the vertical gear effect that results in higher or lower spin and launch angle. Although moving the center of gravity low in the golf club head results in a lower center of gravity projection, due to the loft of the golf club head, moving the center of gravity forward also can provide a lower projection of the center of gravity. The combination of low and forward center of gravity is a very efficient way to achieve low center of gravity projection. However, forward center of gravity can cause the $I_{XX}$ to become undesirably low. Mass distributions which achieve low CG projection without detrimental effect on moment of inertia in general—and $I_{xx}$, specifically—would be most beneficial to achieve both favorable flight conditions and more forgiveness on off center hits. A parameter that helps describe to the effectiveness of the center of gravity projection is the ratio of $CG_Z$ (the vertical distance of the center of gravity as measured from the center face along the z-axis) to $CG_Y$ (the distance of the center of gravity as measured rearward from the center face along the y-axis). As the $CG_Z/CG_Y$ ratio becomes more negative, the center of gravity projection would typically become lower, resulting in improved flight conditions.

As such, the current disclosure aims to provide a golf club head having the benefits of a large negative number for $CG_z/CG_y$ (indicating a low CG projection) without substantially reducing the forgiveness of the golf club head for off-center—particularly, above-center—strikes (indicating a higher $I_{xx}$). To achieve the desired results, weight may be distributed in the golf club head in a way that promotes the best arrangement of mass to achieve increased $I_{xx}$, but the mass is placed to promote a substantially large negative number for $CG_z/CG_y$.

For general reference, a golf club head 100 is seen with reference to FIGS. 1A-1D. One embodiment of a golf club head 100 is disclosed and described in with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure.

A three dimensional reference coordinate system 200 is shown. An origin 205 of the coordinate system 200 is located at the geometric center of the face (CF) of the golf club head 100. See U.S.G.A. "Procedure for Measuring the Flexibility of a Golf Clubhead," Revision 2.0, Mar. 25, 2005, for the methodology to measure the geometric center of the striking face of a golf club. The coordinate system 200 includes a z-axis 206, a y-axis 207, and an x-axis 208 (shown in FIG. 1B). Each axis 206, 207, 208 is orthogonal to each other axis 206, 207, 208. The golf club head 100 includes a leading edge 170 and a trailing edge 180. For the purposes of this disclosure, the leading edge 170 is defined by a curve, the curve being defined by a series of forwardmost points, each forwardmost point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

Figure 1B:
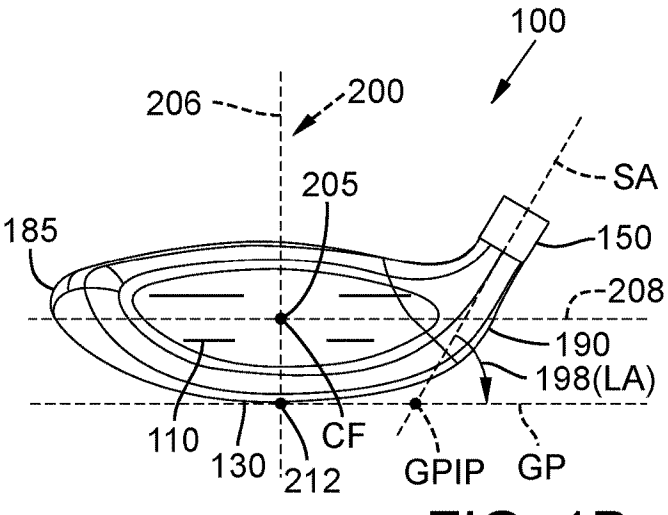
FIG. 1B is a face side view of the golf club head of FIG. 1A.
Figure 1C:
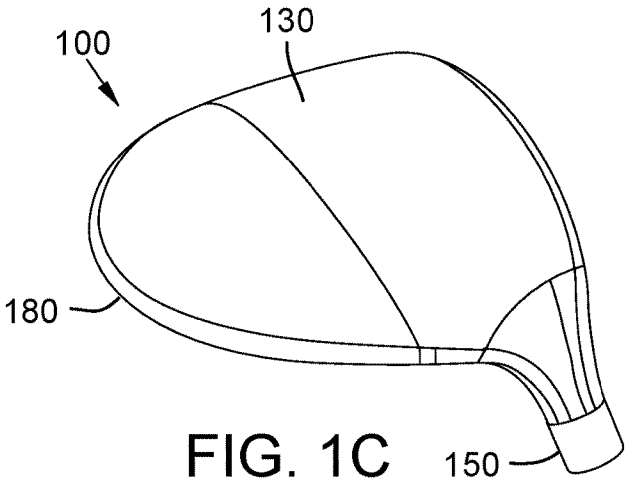
FIG. 1C is a perspective view of the golf club head of FIG. 1A.
Figure 1D:
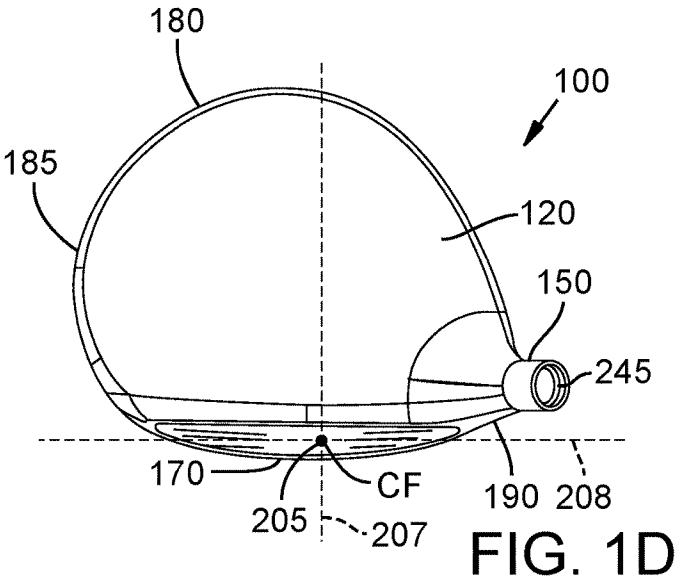
FIG. 1D is a top side view of the golf club head of FIG. 1A.

As seen with reference to FIG. 1B, the x-axis 208 is parallel to a ground plane (GP) onto which the golf club head 100 may be properly soled—arranged so that the sole 130 is in contact with the GP in the desired arrangement of the golf club head 100. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 is known in the art as the lie angle (LA) of the golf club head 100. A ground plane intersection point (GPIP) of the SA and the GP is shown for reference. In various embodiments, the GPIP may be used as a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP. The top view seen in FIG. 1D shows another view of the golf club head 100. The shaft bore 245 can be seen defined in the hosel 150.

Referring back to FIG. 1A, a crown height 162 is shown and measured as the height from the GP to the highest point of the crown 120 as measured parallel to the z-axis 206. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In various embodiments, the effective face position height 164 may be 2-6 mm. In various embodiments, the effect face position height 164 may be 0-10 mm. A distance 177 of the golf club head 100 as measured in the direction of the y-axis 207 is seen as well with reference to FIG. 1A. The distance 177 is a measurement of the length from the leading edge 170 to the trailing edge 180. The distance 177 may be dependent on the loft of the golf club head in various embodiments.

For the sake of the disclosure, portions and references disclosed above will remain consistent through the various embodiments of the disclosure unless modified. One of skill in the art would understand that references pertaining to one embodiment may be included with the various other embodiments.

One embodiment of a golf club head 1000 of the current disclosure is included and described in FIGS. 2A-2D. The golf club head 1000 includes a mass element 1010 located in the sole 130 of the golf club head 1000. The mass element 1010 is located proximate to the forward/center of the golf club head in the current embodiment but may be split as heel-toe weights or may be in various other arrangements. A distance 177 of the golf club head 1000 is about 110.8 mm in the current embodiment. In various embodiments, the distance 177 may be highly variant, from under 90 mm to greater than 140 mm. A sole feature 1020 is included as an extended portion of the body of the golf club head 1000. The sole feature 1020 provides a location of additional mass to help lower center of gravity and provide increased moment of inertia. The sole feature 1020 adds about 5-15 cubic centimeters of volume to the golf club head 1000 in various embodiments. In the current embodiment, the sole feature 1020 adds about 9.2 cc of volume to the golf club head 1000.

In the view of FIGS. 2A-2D (and all remaining figures of the current disclosure), the golf club head is set up to be ideally positioned according to USGA procedure-specifically, with the face square at normal address position, with the shaft axis aligned in a neutral position (parallel to the x-z plane), and with a lie angle of about 60 degrees, regardless of the lie specified for the particular embodiment. The mass element 1010 of the current embodiment is 33.6 grams, although varying mass elements may be utilized in varying embodiments. The sole feature 1020 is makes up about 20.5 grams of mass, although widely variant mass may be utilized in varying embodiments. The sole feature 1020 of the current embodiment is entirely titanium, and in various embodiments may include various materials including lead, steel, tungsten, aluminum, and various other materials of varying densities. It would be understood by one of ordinary skill in the art that the various mass elements and mass features of the various embodiments of the current disclosure may be of various materials, including those mentioned above, and the various materials and configurations may be interchangeable between the various embodiments to achieve ideal playing conditions.

Figure 2A:
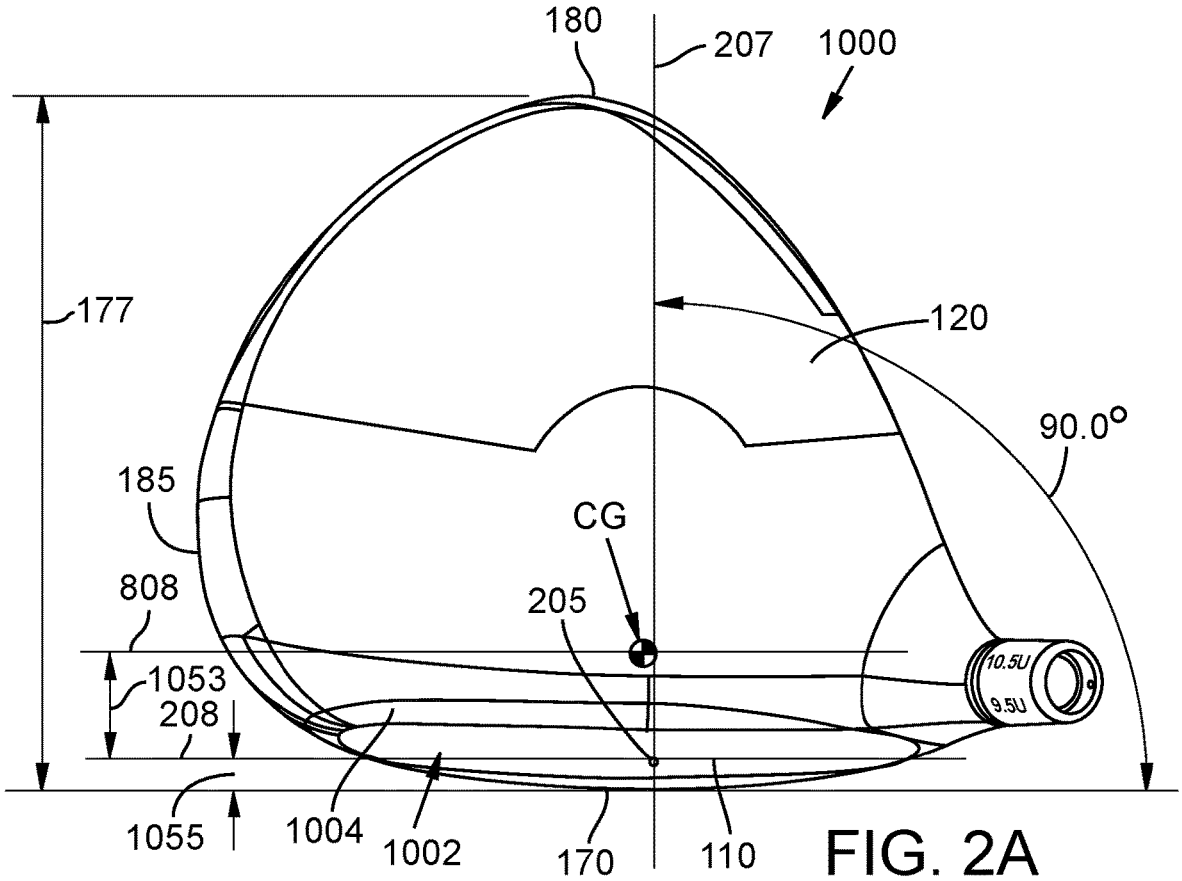
FIG. 2A is a top side view of a golf club head in accord with one embodiment of the current disclosure.

With specific reference to FIG. 2A the golf club head 1000 of the current embodiment includes a face insert 1002 that includes the face 110 and an interface portion 1004 interfacing with the crown 120 and a small portion of the toe 185. In various embodiments, the face insert 1002 may be various shapes, sizes, and materials. In various embodiments, face inserts may interface with portions of the face 110 of the golf club head 1000 only or may interface with portions outside of the face 110 depending on the design. In the current embodiment, the face insert is a composite material as described in U.S. Pat. No. 7,874,936, entitled "COMPOSITE ARTICLES AND METHODS FOR MAKING THE SAME," filed Dec. 19, 2007. Various materials may be used, including various metals, composites, ceramics, and various organic materials. In the current embodiment, the face insert 1002 is composite material such that mass in the face 110 of the golf club head 1000 can be relocated to other portions as desired or so that the golf club head 1000 can be made of especially low mass. In various embodiments, the mass of the golf club head 1000 is reduced by a mass savings of 10-20 grams. In the current embodiment, a mass savings of 10 grams is seen as compared to a comparable golf club head 1000 of the same embodiment with a metallic face insert 1002. As indicated previously, the distance 177 of the golf club head is about 110.8 mm in the current embodiment but may vary in various embodiments and as will be seen elsewhere in this disclosure. In the current embodiment, the golf club head 1000 is of a volume of about 455-464 cubic centimeters (CCs). A distance 1055 between the origin 205 and the leading edge 170 as measured in the direction of the y-axis 207 is seen in the current view. For golf club head 1000, the distance is about 3.6 mm.

Figure 2B:
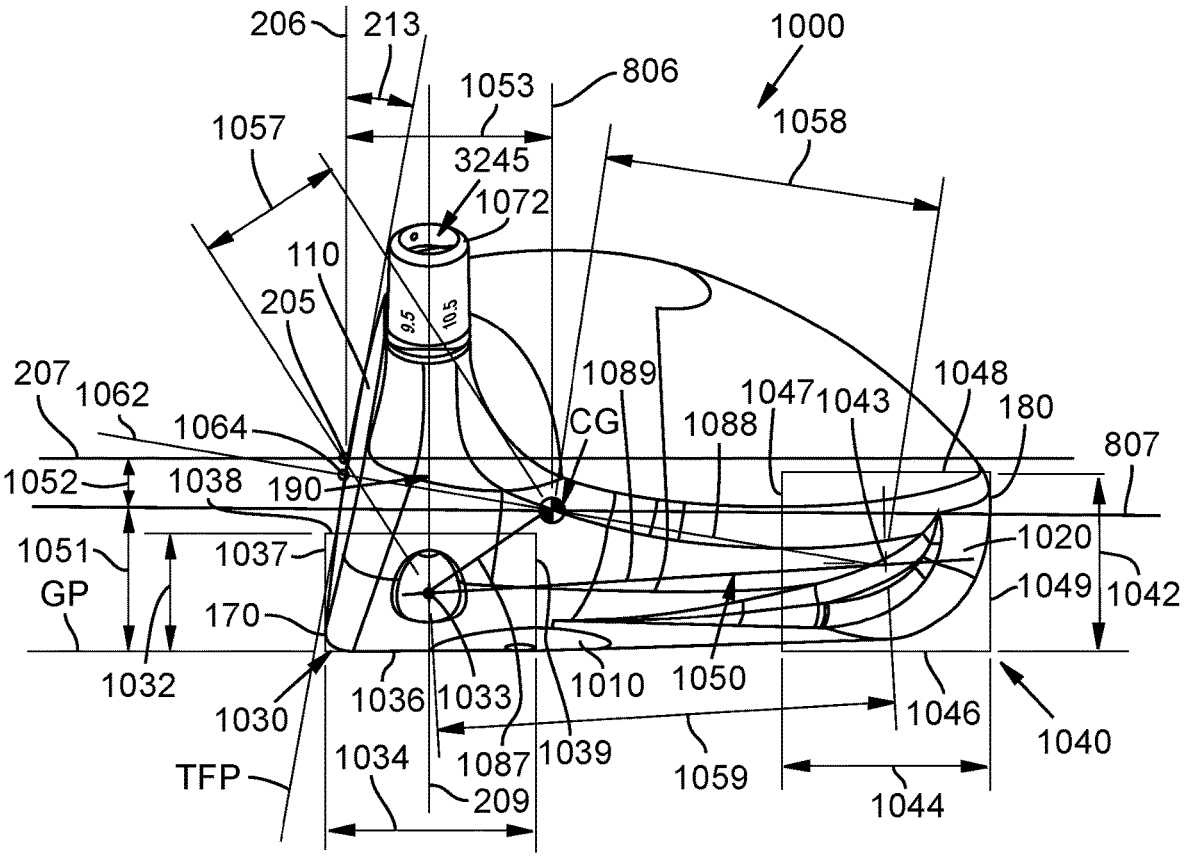
FIG. 2B is a heel side view of the golf club head of FIG. 2A.

As seen with specific reference to FIG. 2B, a forward mass box 1030 and a rearward mass box 1040 are seen drawn for reference only. The mass boxes 1030, 1040 are not features of the golf club head 1000 and are shown for reference to illustrate various features of the golf club head 1000. The view of FIG. 2B shows the heel 190. As such, the view of FIG. 2B shows the view of the y-z plane, or the plane formed by the y-axis 207 and the z-axis 206. As such, distances of the various mass boxes 1030, 1040 as described herein are measured as projected onto the y-z plane.

Each mass box 1030, 1040 represents a defined zone of mass allocation for analysis and comparison of the golf club head 1000 and the various golf club heads of the current. In the current embodiment, each mass box 1030, 1040 is rectangular in shape, although in various embodiments mass definition zones may be of various shapes.

The forward mass box 1030 has a first dimension 1032 as measured parallel to the z-axis 206 and a second dimension 1034 as measured parallel to the y-axis 207. In the current embodiment, the first dimension 1032 is measured from the GP. In the current embodiment, the first dimension 1032 measures a distance of the mass box 1030 from a first side 1036 to a third side 1038 and the second dimension 1034 measures a distance of the mass box 1030 from a second side 1037 to a fourth side 1039. The forward mass box 1030 includes the first side 1036 being coincident with the GP. The second side 1037 is parallel to the z-axis 206 and is tangent to the leading edge 170 such that the forward mass box 1030 encompasses a region that is defined as the lowest and most forward portions of the golf club head 1000. The forward mass box 1030 includes a geometric center point 1033. One of skill in the art would understand that the geometric center point 1033 of the forward mass box 1030 is a point located one-half the first dimension 1032 from the first side 1036 and the third side 1038 and one-half the second dimension 1034 from the second side 1037 and the fourth side 1039. In the current embodiment, the first dimension 1032 is about 20 mm and the second dimension 1034 is about 35 mm. In various embodiments, it may be of value to characterize the mass distribution in various golf club heads in terms of different geometric shapes or different sized zones of mass allocation, and one of skill in the art would understand that the mass boxes 1030, 1040 of the current disclosure should not be considered limiting on the scope of this disclosure or any claims issuing therefrom.

The rearward mass box 1040 has a first dimension 1042 as measured parallel to the z-axis 206 and a second dimension 1044 as measured parallel to the y-axis 207. In the current embodiment, the first dimension 1042 is measured from the GP. In the current embodiment, the first dimension 1042 measures a distance of the mass box 1040 from a first side 1046 to a third side 1048 and the second dimension 1044 measures a distance of the mass box 1040 from a second side 1047 to a fourth side 1049. The rearward mass box 1040 includes the first side 1046 being coincident with the GP. The fourth side 1049 is parallel to the z-axis 206 and is tangent to the trailing edge 180 such that the rearward mass box 1040 encompasses a region that is defined as the lowest and most rearward portions of the golf club head 1000. The rearward mass box 1040 includes a geometric center point 1043. One of skill in the art would understand that the geometric center point 1043 of the rearward mass box 1040 is a point located one-half the first dimension 1042 from the first side 1046 and the third side 1048 and one-half the second dimension 1044 from the second side 1047 and the fourth side 1049. In the current embodiment, the first dimension 1042 is about 30 mm and the second dimension 1044 is about 35 mm. In various embodiments, it may be of value to characterize the mass distribution in various golf club heads in terms of different geometric shapes or different sized zones of mass allocation, and one of skill in the art would understand that the mass boxes 1030, 1040 of the current disclosure should not be considered limiting on the scope of this disclosure or any claims issuing therefrom.

The mass boxes 1030, 1040 illustrate an area of the golf club head 1000 inside which mass is measured to provide a representation of the effectiveness of mass distribution in the golf club head 1000. The forward mass box 1030 is projected through the golf club head 1000 in direction parallel to x-axis 208 (shown in FIG. 1D) and parallel to the GP and captures all mass drawn inside the forward mass box 1030. The rearward mass box 1040 is projected through the golf club head 1000 in direction parallel to x-axis 208 (shown in FIG. 1D) and parallel to the GP and captures all mass drawn inside the rearward mass box 1040.

In the current embodiment, the forward mass box 1030 encompasses 55.2 grams and the rearward mass box 1040 encompasses 30.1 grams, although varying embodiments may include various mass elements. Additional mass of the golf club head 1000 is 125.2 grams outside of the mass boxes 1030, 1040.

A center of gravity (CG) of the golf club head 1000 is seen as annotated in the golf club head 1000. The overall club head CG includes all components of the club head as shown, including any weights or attachments mounted or otherwise connected or attached to the club body. The CG is located a distance 1051 from the ground plane as measured parallel to the z-axis 206. The distance 1051 is also termed $\Delta_Z$ in various embodiments and may be referred to as such throughout the current disclosure. The CG is located a distance 1052 from the origin 205 as measured parallel to the z-axis 206. The distance 1052 is also termed $CG_Z$ in various embodiments and may be referred to as such throughout the current disclosure. $CG_Z$ is measured with positive upwards and negative downwards, with the origin 205 defining the point of 0.0 mm. In the current embodiment, the $CG_Z$ location is −8.8 mm, which means that the CG is located 8.8 mm below center face as measured perpendicularly to the ground plane. The CG is located a distance 1053 from the origin 205 as measured parallel to the y-axis 207. The distance 1053 is also termed $CG_Y$ in various embodiments and may be referred to as such throughout the current disclosure. In the current embodiment, the distance 1051 is 24.2 mm, the distance 1052 is −8.8 mm, and the distance 1053 is 33.3 mm.

A first vector distance 1057 defines a distance as measured in the y-z plane from the geometric center point 1033 of the forward mass box 1030 to the CG. In the current embodiment, the first vector distance 1057 is about 24.5 mm. A second vector distance 1058 defines a distance as measured in the y-z plane from the CG to the geometric center point 1043 of the rearward mass box 1040. In the current embodiment, the second vector distance 1058 is about 56.2 mm. A third vector distance 1059 defines a distance as measured in the y-z plane from the geometric center point 1033 of the forward mass box 1030 to the geometric center point 1043 of the rearward mass box 1040. In the current embodiment, the third vector distance 1059 is about 76.3 mm.

As can be seen, the locations of the CG, the geometric center point 1033, and the geometric center point 1043 form a vector triangle 1050 describing the relationships of the various features. The vector triangle 1050 is for reference and does not appear as a physical feature of the golf club head 1000. As will be discussed in more detail later in this disclosure, the vector triangle 1050 may be utilized to determine the effectiveness of a particular design in improving performance characteristics of the of the golf club heads of the current disclosure. The vector triangle 1050 includes a first leg 1087 corresponding to the distance 1057, a second leg 1088 corresponding to the distance 1058, and a third leg 1089 corresponding to the third distance 1059.

A tangent face plane TFP can be seen in the view of FIG. 2B as well. The TFP is a plane tangent to the face 110 at the origin 205 (at CF). The TFP 235 approximates a plane for the face 110, even though the face 110 is curved at a roll radius and a bulge radius. The TFP is angled at an angle 213 with respect to the z-axis 206. The angle 213 in the current embodiment is the same as a loft angle of the golf club head as would be understood by one of ordinary skill in the art. A shaft plane z-axis 209 is seen and is coincident (from the current view) with the SA. In various embodiments, the shaft plane z-axis 209 is a projection of the SA onto the y-z plane. For the current embodiment, the SA is entirely within a plane that is parallel to an x-z plane—a plane formed by the x-axis 208 and the z-axis 206. As such, in the current embodiment, the shaft plane z-axis 209 is parallel to the z-axis 206. In some embodiments, the SA will not be in a plane parallel to the plane formed by the x-axis 208 and the z-axis 206.

A CG projection line 1062 shows the projection of the CG onto the TFP at a CG projection point 1064. CG projection point 1064 describes the location of the CG as projected onto the TFP at a 90° angle. As such, the CG projection point 1064 allows for description of the CG in relation to the center face (CF) point at the origin 205. The CG projection point 1064 of the current embodiment is offset from the CF 205. The offset of the CG projection point 1064 from the CF 205 may be measured along the TFP in various embodiments or parallel to the z-axis in various embodiments. In the current embodiment, the offset distance of the CG projection point 1064 from the CF 205 is about −2.3 mm, meaning that the CG projects about 2.3 mm below center face.

In various embodiments, the dimensions and locations of features disclosed herein may be used to define various ratios, areas, and dimensional relationships—along with, inter alia, various other dimensions of the golf club head 1000—to help define the effectiveness of weight distribution at achieving goals of the design.

The CG defines the origin of a CG coordinate system including a CG z-axis 806, a CG y-axis 807, and a CG x-axis 808 (shown in FIG. 2A). The CG z-axis 806 is parallel to the z-axis 206; the CG y-axis 807 is parallel to the y-axis 207; the CG x-axis 808 is parallel to the x-axis 208. As described with reference to U.S. Pat. No. 7,731,603, entitled "GOLF CLUB HEAD," filed Sep. 27, 2007, the moment of inertia (MOI) of any golf club head can be measured about the CG with particular reference to the CG axes as defined herein. $I_{xx}$ is a moment of inertia about the CG x-axis 808; $I_{yy}$ is a moment of inertia about the CG y-axis 807; $I_{zz}$ is a moment of inertia about the CG z-axis 806.

As described elsewhere in this disclosure, particularly low MOI can lead to instability for off-center hits. However, MOI is typically proportioned to particular mass using the length and the magnitude of the mass. One example appears in the equation below:

$$I \propto m \times L^2$$

where I is the moment of inertia, m is the mass, and L is the distance from the axis of rotation to the mass (with α indicating proportionality). As such, distance from the axis of rotation to the mass is of greater importance than magnitude of mass because the moment of inertia varies with the square of the distance and only linearly with respect to the magnitude of mass.

In the current embodiment of the golf club head 1000, the inclusion of multiple mass elements—including mass element 1010 and sole feature 1020—allows mass to be located distal to the center of gravity. As a result, the moment of inertia of the golf club head 1000 is higher than some comparable clubs having similar CG locations. $I_{xx}$ in the current embodiment is about 283 kg-mm$^2$. $I_{zz}$ in the current embodiment is about 380 kg-mm$^2$.

In golf club heads of many prior designs, the main mechanism for increasing MOI was to move a substantial proportion of the golf club head mass as far toward the trailing edge 180 as possible. Although such designs typically achieved high MOI, the projection of the CG onto the TFP was particularly high, reducing performance of the golf club head by negating the benefits of low CG.

Magnitudes of the mass boxes 1030, 1040 provides some description of the effectiveness of increasing moment of inertia in the golf club head 1000. The vector triangle 1050 provides a description of the effectiveness of increasing MOI while maintaining a low CG in the golf club head 1000. Additionally, the golf club head 1000 can be characterized using ratios of the masses within the mass boxes 1030, 1040 (55.2 g and 30.1 g, respectively) as compared to the mass of the golf club head 1000 outside of the mass boxes (125.2 g). As previously described, low CG provides benefits of a low CG projection onto the TFP. As such, to increase MOI without suffering negative effects of low MOI, multiple masses located low in the golf club head 1000 can produce high stability while allowing the performance gains of a low CG.

One method to quantify the effectiveness of increasing MOI while lowering CG location in the golf club head 1000 is to determine an area of the vector triangle 1050. Area of the vector triangle 1050 is found using the following equation:

$$A = \sqrt{s(s-a)(s-b)(s-c)}$$

where $$s = \frac{a+b+c}{2}$$

Utilizing the area calculation, A of the vector triangle 1050 is about 456 $mm^2$.

One method to quantify the effectiveness of increasing the MOI while lowering CG location in the golf club head 1000 is to provide ratios of the various legs 1087, 1088, 1089 of the vector triangle 1050. In various embodiments, a vector ratio is determined as a ratio of the sum of the distances of the first leg 1087 and second leg 1088 of the vector triangle 1050 as compared to the third leg 1089 of the vector triangle 1050. With reference to the vector triangle 1050, the legs are of the first distance 1057, the second distance 1058, and the third distance 1059, as previously noted. As oriented, the first leg 1087 and the second leg 1088 are both oriented above the third leg 1089. In most embodiments, one leg of the vector triangle 1050 will be larger than the other two legs. In most embodiments, the largest leg of the vector triangle 1050 will be the third leg 1089. In most embodiments, the vector ratio is determined by taking a ratio of the sum of the two minor legs as compared to the major leg. In some embodiments, it is possible that the third leg 1089 is smaller than one of the other two legs, although such embodiments would be rare for driver-type golf club heads. The vector ratio can be found using the formula below:

$$VR = \frac{a+b}{c}$$

where VR is the vector ratio, a is the first distance 1057 as characterizing the first leg 1087, b is the second distance 1058 as characterizing the second leg 1088, and c is the third distance 1059 as characterizing the third leg 1089. In all embodiments, the vector ratio should be at least 1, as mathematical solutions of less than 1 would not indicate that a triangle had been formed. In the current embodiment, the vector ratio is about (24.5+56.2)/76.3=1.0577.

In various embodiments, the largest leg may not be the third leg. In such embodiments, the third distance 1059 should still be utilized as element c in the equation above to maintain the relation of the vector ratio to a low CG and high MOI. In various embodiments, vector triangles may be equilateral (all legs equidistant) or isosceles (two legs equidistant). In the case of an equilateral triangle, the vector ratio will be 2.0000.

In various embodiments, the effectiveness of CG location may be characterized in terms of $CG_Z$ and in terms of the relation of $CG_Z$ to $CG_Y$. In various embodiments, the effectiveness of CG location may be characterized in terms of $\Delta_Z$ and in relation to $CG_Z$. In various embodiments, $CG_Z$ may be combined with MOI to characterize performance. In various embodiments, $CG_Z$ and $CG_Y$ may be combined with MOI to characterize performance. Various relationships disclosed herein may be described in greater detail with reference to additional figures of the current disclosure, but one of skill in the art would understand that no particular representation should be considered limiting on the scope of the disclosure.

In various embodiments, the moment of inertia contribution of mass located inside the mass boxes can be somewhat quantified as described herein. To characterize the contribution to moment of inertia of the mass of the golf club head located within the mass box, a MOI effectiveness summation (hereinafter $MOI_{eff}$) is calculated utilizing the mass within each of the mass boxes 1030, 1040 and the length between the CG and each geometric center 1033, 1043 using the equation below:

$$MOI_{eff} = m_1 L_1^2 + m_2 L_2^2$$

where $m_n$ is the mass within a particular mass box n (such as mass boxes 1030, 1040) and $L_n$ is the distance between the CG and the mass box n (distances 1057, 1058, respectively). In the current embodiment, $MOI_{eff}$=(55.2 grams)×(24.5 mm)$^2$+(30.1 grams)×(56.2 mm)$^2$≈128,200 g·mm$^2$=128.2 kg·mm$^2$. Although this is not an exact number for the moment of inertia provided by the mass inside the mass boxes, it does provide a basis for comparison of how the mass in the region of the mass boxes affects MOI in the golf club head such as golf club head 1000.

In various embodiments, an MOI effectiveness summation ratio ($R_{MOI}$) may be useful as the ratio of $MOI_{eff}$ to the overall club head MOI in the y-z plane ($I_{xx}$). In the current embodiment, the $R_{MOI}=MOI_{eff}/I_{xx}$=128.2 kg·mm$^2$/283 kg·mm$^2$≈0.453.

As can be seen, the golf club head 1000 and other golf club heads of the current disclosure include adjustable loft sleeves, including loft sleeve 1072. Adjustable loft technology is described in greater detail with reference to U.S. Pat. No. 7,887,431, entitled "GOLF CLUB," filed Dec. 30, 2008, incorporated by reference herein in its entirety, and in additional applications claiming priority to such application. However, in various embodiments, adjustable loft need not be required for the functioning of the current disclosure.

In addition to the features described herein, the embodiment of FIGS. 2A-2D also includes an aerodynamic shape as described in accord with Application for Application for U.S. Patent bearing Ser. No. 13/718,107, entitled "HIGH VOLUME AERODYNAMIC GOLF CLUB HEAD," filed Dec. 18, 2012. Various factors may be modified to improve the aerodynamic aspects of the invention without modifying the scope of the disclosure. In various embodiments, the volume of the golf club head 1000 may be 430 cc to 500 cc. In the current embodiment, there are no inversions, indentations, or concave shaping elements on the crown of the golf club, and, as such, the crown remains convex over its body, although the curvature of the crown may be variable in various embodiments.

Figure 2C:
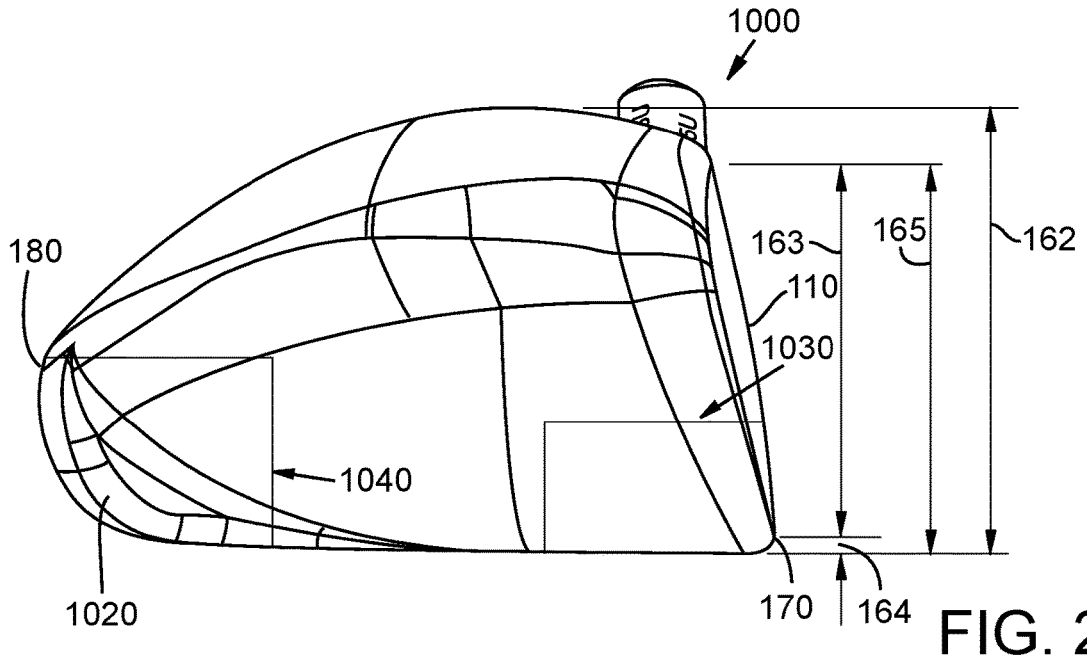
FIG. 2C is a toe side view of the golf club head of FIG. 2A.

As seen with reference to FIG. 2C, the effective face height 163 and crown height 162 are shown. The effective face height 163 is 56.5 mm in the current embodiment. A face height 165 is shown and is about 59.1 mm in the current embodiment. The face height 165 is a combination of the effective face height 163 and the effective face position height 164. The crown height 162 is about 69.4 mm in the current embodiment. As can be seen a ratio of the crown height 162 to the face height 165 is 69.4/59.1, or about 1.17. In various embodiments, the ratio may change and is informed and further described by Applications for U.S. Patent bearing Ser. No. 13/718,107, entitled "HIGH VOLUME AERODYNAMIC GOLF CLUB HEAD," filed Dec. 18, 2012. The view of FIG. 2C includes projections of the forward mass box 1030 and the rearward mass box 1040 as seen from the toe side view. It should be noted that portions of the mass boxes 1030, 1040 that fall outside of the golf club head 1000 have been removed from the view of FIG. 2C.

Figure 2D:
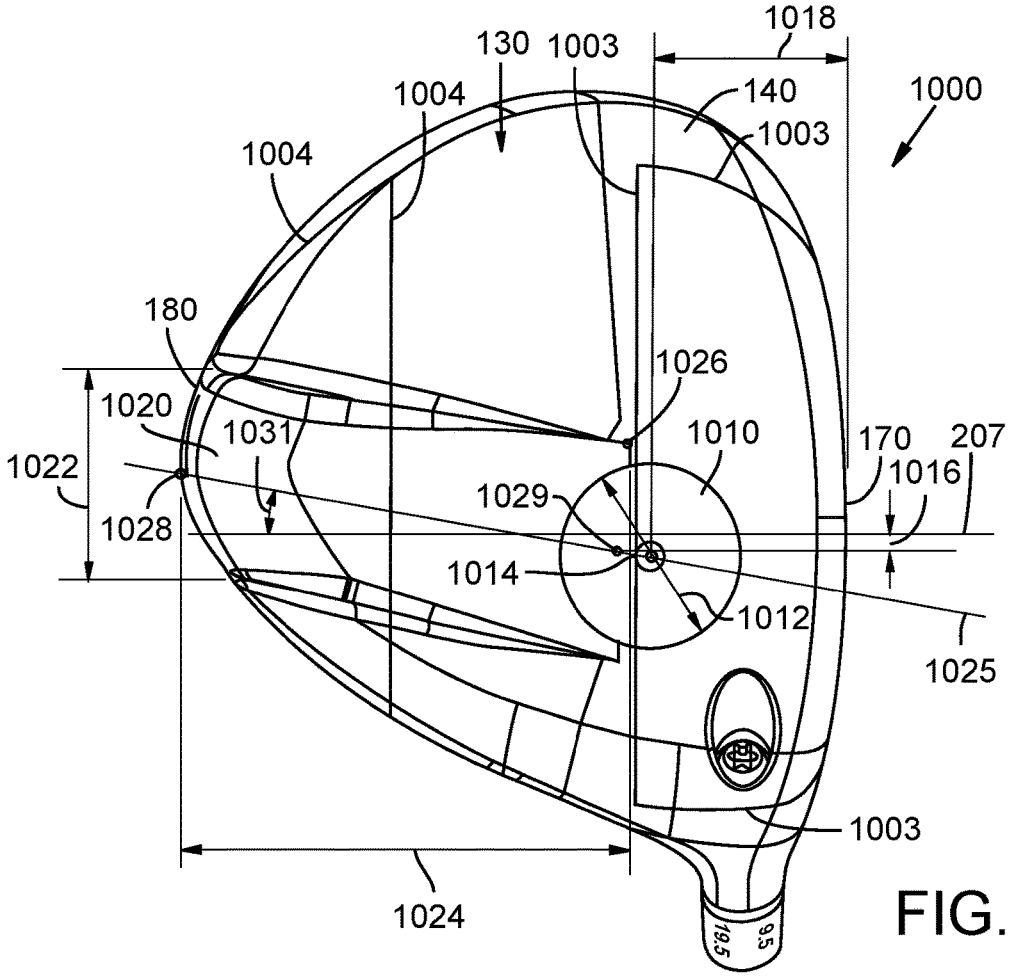
FIG. 2D is a sole side view of the golf club head of FIG. 2A.

As seen with specific reference to FIG. 2D, mass element 1010 is seen in its proximity to the leading edge 170 as well as to the y-axis 207. In the current embodiment, the mass element 1010 is circular with a diameter 1012 of about 30 mm. A center point 1014 of the mass element 1010 is located a distance 1016 from the y-axis 207 as measured in a direction parallel to the x-axis 208 (seen in FIG. 2A). The mass element 1010 of the current embodiment is of tungsten material and weighs about 35 grams, although various sizes, materials, and weights may be found in various embodiments. The center point 1014 of the mass element 1010 is located a distance 1018 from the leading edge 170 as measured parallel to the y-axis 207. In the current embodiment, the distance 1016 is 3.2 mm and the distance 1018 is 32.6 mm.

The sole feature 1020 of the current embodiment is shown to have a width 1022 as measured in a direction parallel to the x-axis 208 of about 36.6 mm. The sole feature 1020 has a length 1024 of about 74.5 mm as measured parallel to the y-axis 207 from a faceward most point 1026 of the sole feature 1020 to a trailing edge point 1028 coincident with the trailing edge 180. Although the sole feature 1020 has some contour and variation along the length 1024, the sole feature 1020 remains about constant width 1022. In the current embodiment, the trailing edge point 1028 is proximate the center of the sole feature 1020 as measured along a direction parallel to the x-axis 208. A first center point 1029 of the sole feature 1020 is located proximate the faceward most point 1026 and identifies an approximate center of the sole feature 1020 at its facewardmost portion. In the current embodiment, the first center point 1029 is located within the mass element 1010, although the first center point 1029 is a feature of the sole feature 1020. A sole feature flow direction 1025 is shown by connecting the first center point 1029 with the trailing edge point 1028. The sole feature flow direction 1025 describes how the sole feature 1020 extends as it continues along the sole 130 of the golf club head 1000. In the current embodiment, the sole feature flow direction 1025 is arranged at an angle 1031 with respect to the y-axis 207 of about 11°. In the current embodiment, the angle 1031 is chosen with arrangement of the angle of approach of the golf club head 1000 during the golf swing to minimize potential air flow drag from interaction of the sole feature 1020 with the air flow around the golf club head 1000.

The view of FIG. 2D displays boundaries 1003, 1004 for the forward mass box 1030 and the rearward mass box 1040, respectively. The boundaries 1003, 1004 display the interaction of the mass boxes 1030, 1040 as being projected through the golf club head 1000 at a certain height from the GP (as shown with reference to FIG. 2B). Because the various surfaces of the golf club head 1000 include various curvatures—for example, along the skirt 140—boundaries 1003, 1004 appear along the curvatures in views other than the view of FIG. 2B. As such, the view of FIG. 2D provides a mapping of portions of the golf club head 1000 that fall within the mass boxes 1030, 1040.

Another embodiment of a golf club head 2000 is seen with reference to FIG. 3A-3D. As seen with specific reference to FIG. 3A, the golf club head 2000 includes an extended trailing edge portion 2025. The extended trailing edge portion 2025 extends the trailing edge 180 and creates an acute shape to a central portion of the trailing edge, the central portion being defined as the portion of the trailing edge 180 proximate the y-axis 207. The golf club head 2000 includes a concavity portion 2027 providing a transition from a portion of the crown 120 proximate a highest crown point 2029 to the trailing edge 180. In the current embodiment, the distance 177 is about 125.1 mm. The crown 120 is concave in shape in the region of the concavity portion 2027. In various embodiments, the concavity portion 2027 may extend to the trailing edge 180 or may transition into a straight portion or a convex portion before the trailing edge 180. In the current embodiment, the golf club head 2000 is of a volume of about 458 CC. A distance 2055 between the origin 205 and the leading edge 170 as measured in the direction of the y-axis 207 is seen in the current view. For golf club head 2000, the distance is about 3.5 mm.

Figure 3A:
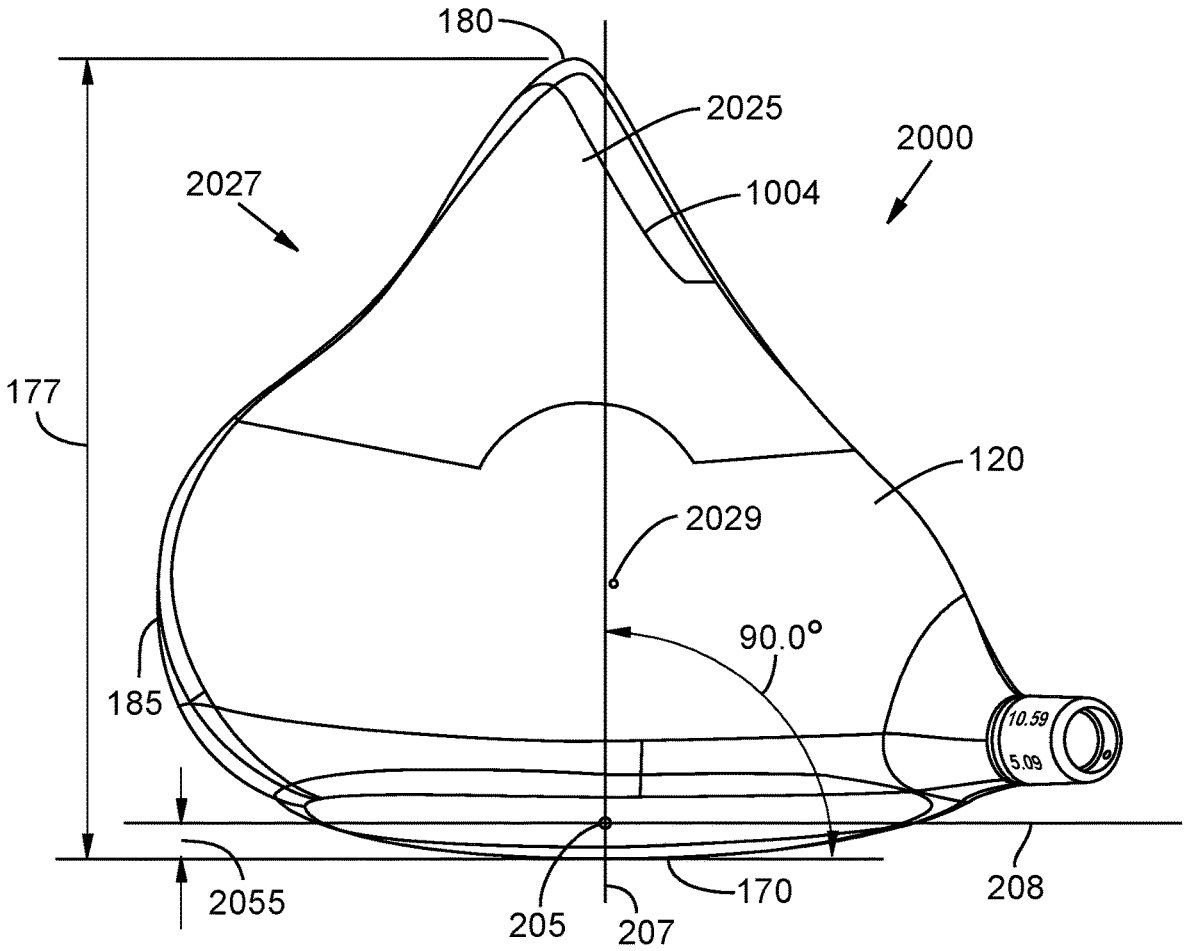
FIG. 3A is a top side view of a golf club head in accord with one embodiment of the current disclosure.
Figure 3B:
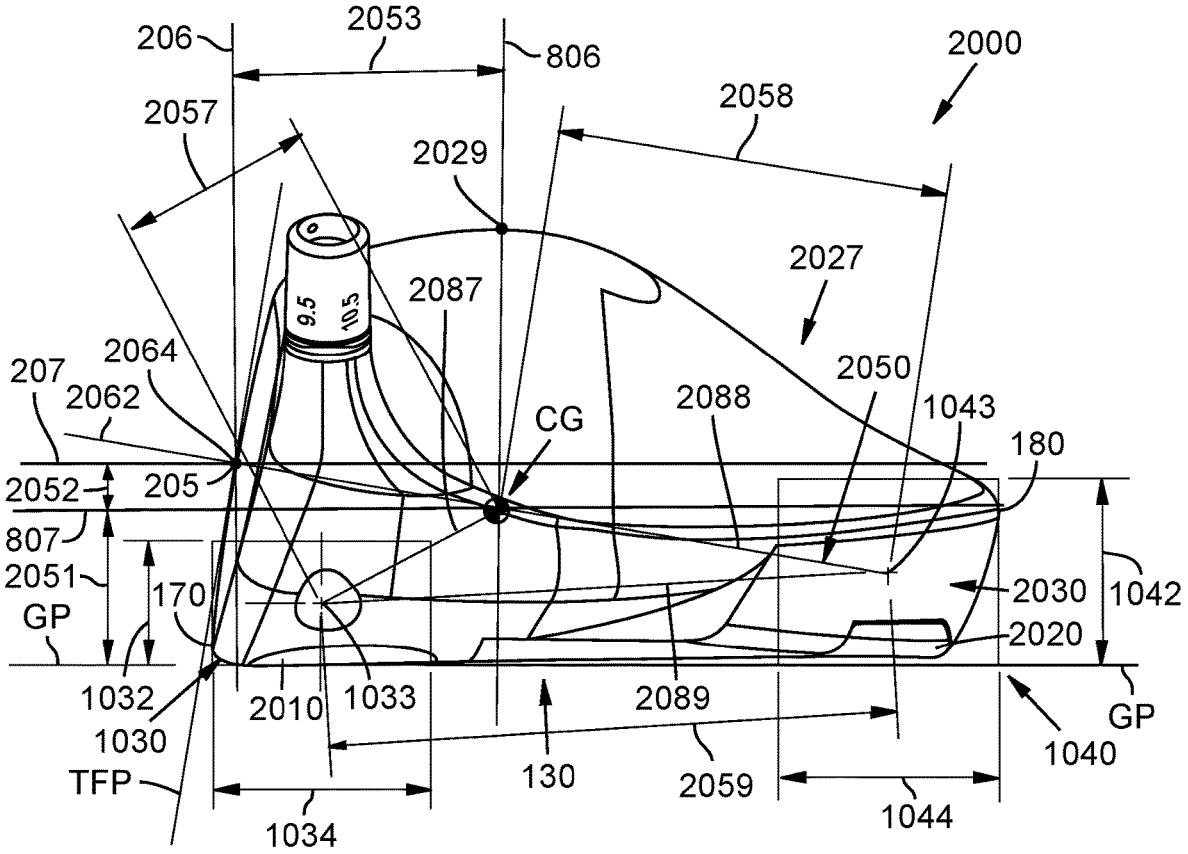
FIG. 3B is a heel side view of the golf club head of FIG. 3A.

As seen with reference to FIG. 3B, the golf club head 2000 includes a first mass element 2010 and a second mass element 2020. In the current embodiment, the first mass element 2010 is about 16 grams and the second mass element 2020 is about 41.5 grams, although various modifications may be found in various embodiments. The mass element 2020 is housed in a sole feature 2021 that is a portion of the golf club head 2000 protruding toward the GP from and including the sole 130. The golf club head 2000 is characterized using the same mass boxes 1030, 1040 defined according to the same procedure as used with respect to golf club head 1000. In the current embodiment, the mass boxes 1030, 1040 remain of the same dimensions themselves but are separated by variations in distances from those of golf club head 1000.

In the current embodiment, the forward mass box 1030 encompasses 46.8 grams and the rearward mass box 1040 encompasses 48.9 grams, although varying embodiments may include various mass elements. Additional mass of the golf club head 2000 is 114.2 grams outside of the mass boxes 1030, 1040.

A CG of the golf club head 2000 is seen as annotated in the golf club head 2000. The overall club head CG includes all components of the club head as shown, including any weights or attachments mounted or otherwise connected or attached to the club body. The CG is located a distance 2051 from the ground plane as measured parallel to the z-axis 206. The distance 2051 is also termed $\Delta_Z$ in various embodiments and may be referred to as such throughout the current disclosure. The CG is located a distance 2052 ($CG_Z$) from the origin 205 as measured parallel to the z-axis 206. In the current embodiment, the $CG_Z$ location is −7.6, which means that the CG is located 7.6 mm below center face as measured perpendicularly to the ground plane. The CG is located a distance 2053 ($CG_Y$) from the origin 205 as measured parallel to the y-axis 207. In the current embodiment, the distance 2051 is 24.6 mm, the distance 2052 is −7.6 mm, and the distance 2053 is 41.9 mm.

A first vector distance 2057 defines a distance as measured in the y-z plane from the geometric center point 1033 of the forward mass box 1030 to the CG. In the current embodiment, the first vector distance 2057 is about 31.6 mm. A second vector distance 2058 defines a distance as measured in the y-z plane from the CG to the geometric center point 1043 of the rearward mass box 1040. In the current embodiment, the second vector distance 2058 is about 63.0 mm. A third vector distance 2059 defines a distance as measured in the y-z plane from the geometric center point 1033 of the forward mass box 1030 to the geometric center point 1043 of the rearward mass box 1040. In the current embodiment, the third vector distance 2059 is about 90.4 mm.

As can be seen, the locations of the CG, the geometric center point 1033, and the geometric center point 1043 form a vector triangle 2050 describing the relationships of the various features. The vector triangle 2050 is for reference and does not appear as a physical feature of the golf club head 2000. The vector triangle 2050 includes a first leg 2087 corresponding to the distance 2057, a second leg 2088 corresponding to the distance 2058, and a third leg 2089 corresponding to the third distance 2059. For calculation of area A and vector ratio VR, distance 2057 is used for a, distance 2058 is used for b, and distance 2059 is used for c in the calculations described above. A of the vector triangle 2050 is 590.75 $mm^2$. VR of the vector triangle 2050 is 1.0465.

A CG projection line 2062 shows the projection of the CG onto the TFP at a CG projection point 2064. The CG projection point 2064 allows for description of the CG in relation to the center face (CF) point at the origin 205. The CG projection point 2064 of the current embodiment is offset from the CF 205. In the current embodiment, the offset distance of the CG projection point 2064 from the CF 205 is about 0.2 mm, meaning that the CG projects about 0.2 mm above center face.

In the current embodiment, $MOI_{eff}$=(46.8 grams)×(31.6 $mm)^2$+(48.9 grams)×(63.0 $mm)^2$≈240,800 g·$mm^2$=240.8 kg·$mm^2$. Although this is not an exact number for the moment of inertia provided by the mass inside the mass boxes, it does provide a basis for comparison of how the mass in the region of the mass boxes affects MOI in the golf club head such as golf club head 2000. In the current embodiment, the $R_{MOI}=MOI_{eff}/I_{xx}$=240.8 kg·$mm^2$/412 kg·$mm^2$≈0.585.

Figure 3C:
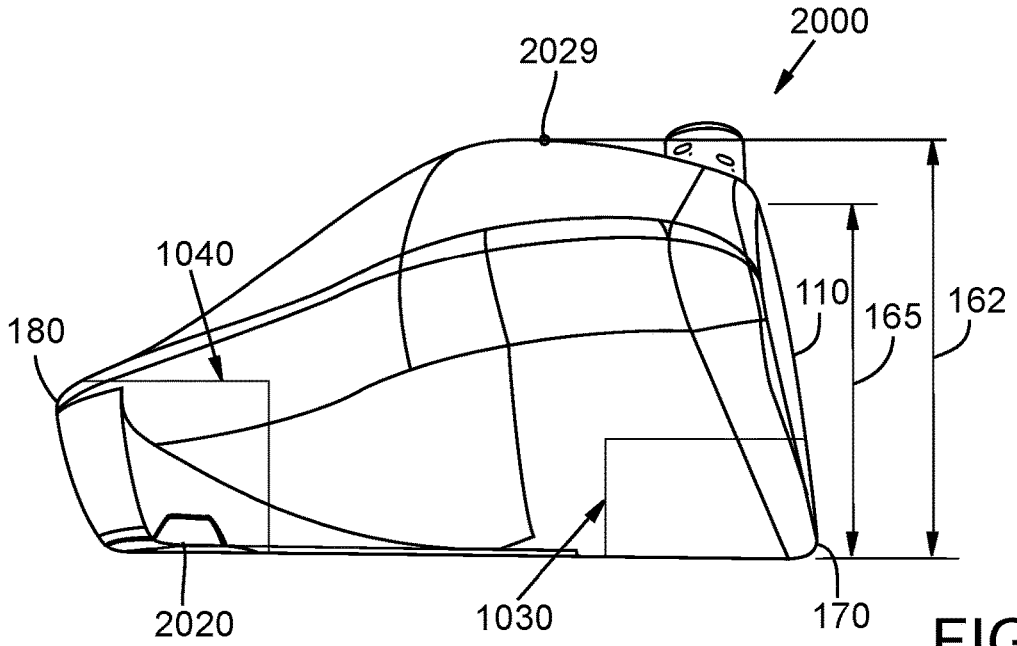
FIG. 3C is a toe side view of the golf club head of FIG. 3A.

The golf club head 2000—as seen with reference to FIG. 3C—includes a face height 165 of about 58.7 mm in the current embodiment. The crown height 162 is about 69.4 mm in the current embodiment. A ratio of the crown height 162 to the face height 165 is 69.4/58.7, or about 1.18.

Figure 3D:
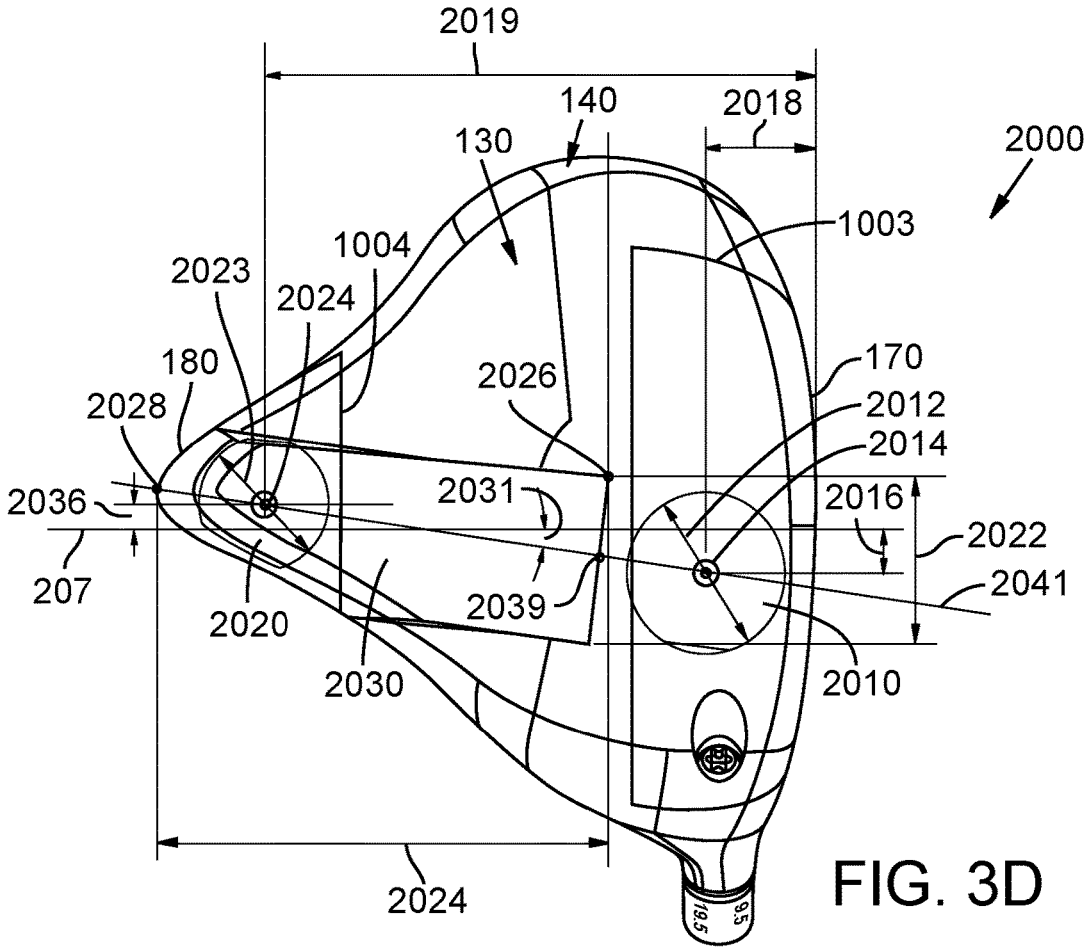
FIG. 3D is a sole side view of the golf club head of FIG. 3A.

As seen with specific reference to FIG. 3D, first mass element 2010 is seen in its proximity to the leading edge 170 as well as to the y-axis 207. In the current embodiment, the first mass element 2010 is circular with a diameter 2012 of about 30 mm. A center point 2014 of the first mass element 2010 is located a distance 2016 from the y-axis 207 as measured in a direction parallel to the x-axis 208 (seen in FIG. 2A). The center point 2014 of the first mass element 2010 is located a distance 2018 from the leading edge 170 as measured parallel to the y-axis 207. In the current embodiment, the distance 2016 is 10.6 mm and the distance 2018 is about 25 mm.

The second mass element 2020 of the current embodiment is also generally circular with truncated sides. The second mass element 2020 has a center point 2024 and a diameter 2023 in the circular portion of the second mass element 2020 of about 25 mm. The center point 2024 of the second mass element 2020 is located a distance 2036 from the y-axis 207 as measured in a direction parallel to the x-axis 208 (seen in FIG. 3A). The center point 2024 of the second mass element 2020 is located a distance 2019 from the leading edge 170 as measured parallel to the y-axis 207. In the current embodiment, the distance 2036 is about 5 mm and the distance 2019 is 104.7 mm.

The sole feature 2030 houses the second mass element 2020 and has a length 2024 as measured parallel to the y-axis 207 from a faceward most point 2026 of the sole feature 2030 to a trailing edge point 2028 coincident with the trailing edge 180. In the current embodiment, the length 2024 is about 85.6 mm.

Although the sole feature 2030 has some variation along the length 2024, the sole feature 2030 remains about constant width 2022 of about 31.8 mm. In the current embodiment, the trailing edge point 2028 is proximate the center of the sole feature 2030 as measured along a direction parallel to the x-axis 208. A first center point 2039 of the sole feature 2030 is located proximate the faceward most point 2026 and identifies an approximate center of the sole feature 2030 at its facewardmost portion. In the current embodiment, the first center point 2039 is located outside of the mass element 2010, in contrast with the golf club head 1000. A sole feature flow direction 2041 is shown by connecting the first center point 2039 with the trailing edge point 2028. The sole feature flow direction 2041 describes how the sole feature 2030 extends as it continues along the sole 130 of the golf club head 2000. In the current embodiment, the sole feature flow direction 2041 is arranged at an angle 2031 with respect to the y-axis 207 of about 9°. In the current embodiment, the angle 2031 is chosen with arrangement of the angle of approach of the golf club head 2000 during the golf swing to minimize potential air flow drag from interaction of the sole feature 2030 with the air flow around the golf club head 2000.

The view of FIG. 3D displays boundaries 1003, 1004 for the forward mass box 1030 and the rearward mass box 1040, respectively. The boundaries 1003, 1004 display the interaction of the mass boxes 1030, 1040 as being projected through the golf club head 2000 at a certain height from the GP (as shown with reference to FIG. 3B). Because the various surfaces of the golf club head 1000 include various curvatures—for example, along the skirt 140—boundaries 1003, 1004 appear along the curvatures in views other than the view of FIG. 3B. As such, the view of FIG. 3D provides a mapping of portions of the golf club head 2000 that fall within the mass boxes 1030, 1040.

Another embodiment of a golf club head 3000 is seen with reference to FIG. 4A-4D. The golf club head 3000 includes mass element 3020. It should be noted that properties and measurements of the golf club head 3000 of the current embodiment are measured in the orientation shown as described with respect to USGA procedure outlined elsewhere in this disclosure. Various measurements may be different for golf club head 3000 in different orientations, and one of skill in the art would understand that the USGA procedure angle of orientation of the golf club head differs from the ideal angle of orientation based on the particular design of golf club head 3000. Accordingly, certain measurements may be slightly variant from the ideal measurement orientation. However, all golf club heads of the current disclosure are analyzed and measured according to standard procedure described herein. In the current embodiment, the variation of orientation accounts for less than 2 mm difference in measurement of CG location, for example. As such, measurement variation may be negligible in certain situations.

Figure 4A:
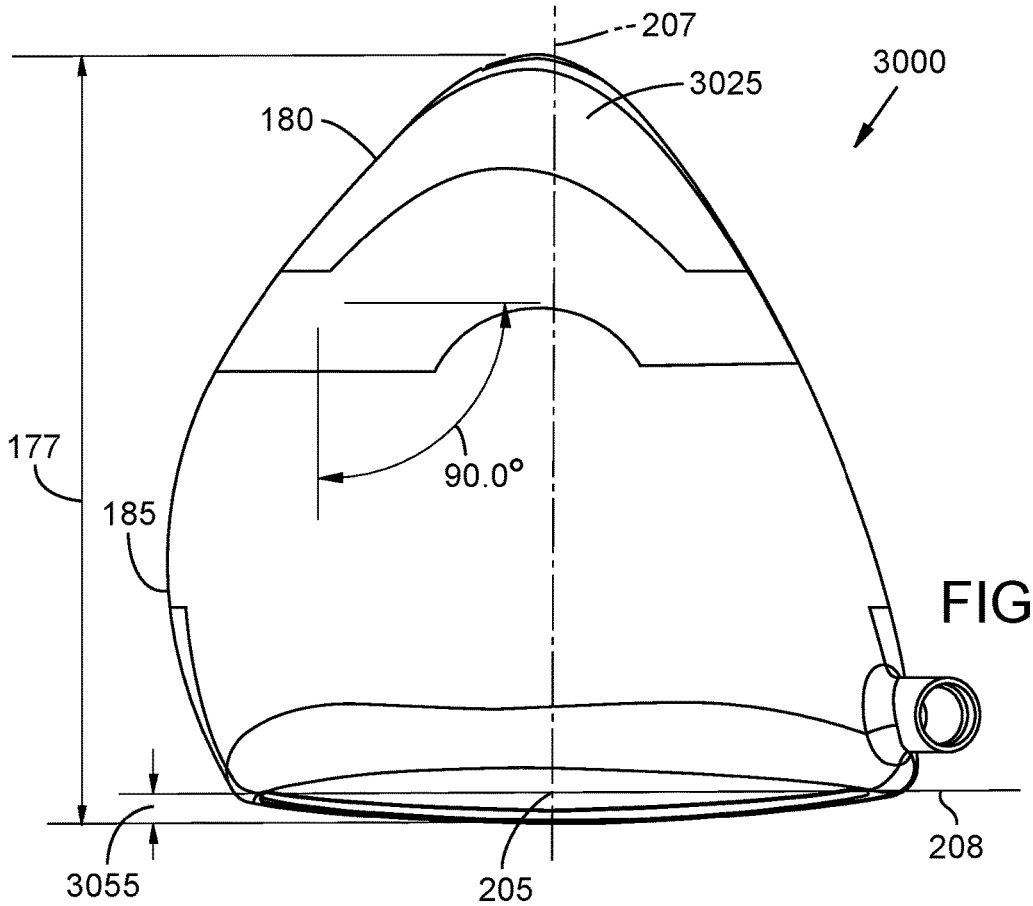
FIG. 4A is a view of a golf club head in accord with one embodiment of the current disclosure.

As seen with specific reference to FIG. 4A, the golf club head 3000 includes an extended trailing edge portion 3025. The extended trailing edge portion 3025 extends the trailing edge 180 and creates an acute shape to a central portion of the trailing edge 180, the central portion being defined as the portion of the trailing edge 180 proximate the y-axis 207. The golf club head 3000 does not include any concavities in the current embodiment (as with the golf club head 2000), although one of skill in the art would understand that this disclosure is not limited to convex shaped golf club heads. In the current embodiment, the distance 177 is about 124.3 mm. In various embodiments, the concavity portion 2027 may extend to the trailing edge 180 or may transition into a straight portion or a convex portion before the trailing edge 180. In the current embodiment, the golf club head 4000 is of a volume of about 469 CC. A distance 3055 between the origin 205 and the leading edge 170 as measured in the direction of the y-axis 207 is seen in the current view. For golf club head 3000, the distance is about 3.4 mm.

Figure 4B:
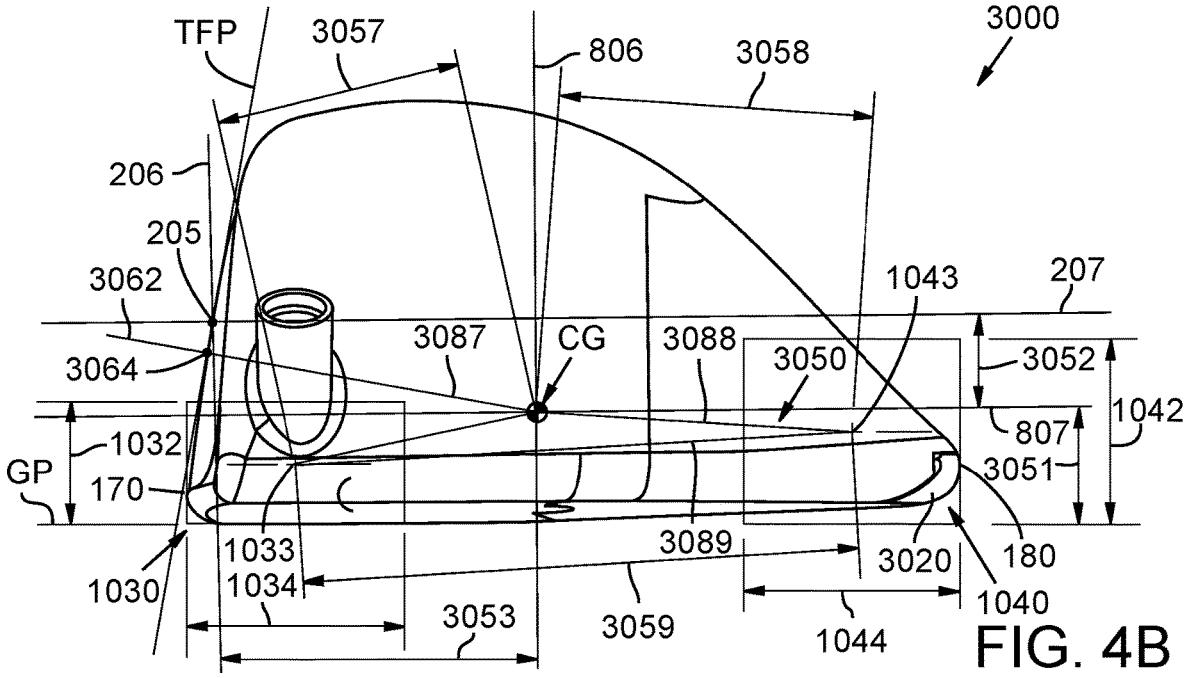
FIG. 4B is a heel side view of the golf club head of FIG. 4A.

As seen with reference to FIG. 4B, the golf club head 3000 includes a mass element 3020 that is external in the current embodiment. In various embodiments, the golf club head 3000 may include various internal mass elements as well as additional external mass elements or may replace various external mass elements with internal mass elements as desired. In the current embodiment, the mass element 3020 is about 58.0 grams, although in various embodiments it may be of various masses. The mass element 3020 is housed in the extended trailing edge portion 3025. The golf club head 3000 is characterized using the same mass boxes 1030, 1040 defined according to the same procedure as used with respect to golf club head 1000. In the current embodiment, the mass boxes 1030, 1040 remain of the same dimensions themselves but are separated by variations in distances from those of golf club heads 1000, 2000.

In the current embodiment, the forward mass box 1030 encompasses 48.9 grams and the rearward mass box 1040 encompasses 74.0 grams, although varying embodiments may include various mass elements. Additional mass of the golf club head 3000 is 87.9 grams outside of the mass boxes 1030, 1040.

A CG of the golf club head 3000 is seen as annotated in the golf club head 3000. The overall club head CG includes all components of the club head as shown, including any weights or attachments mounted or otherwise connected or attached to the club body. The CG is located a distance 3051 from the ground plane as measured parallel to the z-axis 206. The distance 3051 is also termed $\Delta_Z$ in various embodiments and may be referred to as such throughout the current disclosure. The CG is located a distance 3052 ($CG_Z$) from the origin 205 as measured parallel to the z-axis 206. In the current embodiment, the $CG_Z$ location is −3.3, which means that the CG is located 3.3 mm below center face as measured perpendicularly to the ground plane. The CG is located a distance 3053 ($CG_Y$) from the origin 205 as measured parallel to the y-axis 207. In the current embodiment, the distance 3051 is 18.7 mm, the distance 3052 is −13.3 ($CG_Z$) mm, and the distance 3053 is 52.8 mm.

A first vector distance 3057 defines a distance as measured in the y-z plane from the geometric center point 1033 of the forward mass box 1030 to the CG. In the current embodiment, the first vector distance 3057 is about 39.7 mm. A second vector distance 3058 defines a distance as measured in the y-z plane from the CG to the geometric center point 1043 of the rearward mass box 1040. In the current embodiment, the second vector distance 3058 is about 51.0 mm. A third vector distance 3059 defines a distance as measured in the y-z plane from the geometric center point 1033 of the forward mass box 1030 to the geometric center point 1043 of the rearward mass box 1040. In the current embodiment, the third vector distance 3059 is about 89.6 mm.

As can be seen, the locations of the CG, the geometric center point 1033, and the geometric center point 1043 form a vector triangle 3050 describing the relationships of the various features. The vector triangle 3050 is for reference and does not appear as a physical feature of the golf club head 3000. The vector triangle 3050 includes a first leg 3087 corresponding to the distance 3057, a second leg 3088 corresponding to the distance 3058, and a third leg 3089 corresponding to the third distance 3059. For calculation of area A and vector ratio VR, distance 3057 is used for a, distance 3058 is used for b, and distance 3059 is used for c in the calculations described above. A of the vector triangle 3050 is 312.94 $mm^2$. VR of the vector triangle 3050 is 1.0123.

A CG projection line 3062 shows the projection of the CG onto the TFP at a CG projection point 3064. The CG projection point 3064 allows for description of the CG in relation to the center face (CF) point at the origin 205. The CG projection point 3064 of the current embodiment is offset from the CF 205. In the current embodiment, the offset distance of the CG projection point 3064 from the CF 205 is about −3.3 mm, meaning that the CG projects about 3.3 mm below center face.

In the current embodiment, $MOI_{eff}$=(48.9 grams)×(39.7 mm)$^2$+(74.0 grams)×(51.0 mm)$^2$≈269,500 g·mm$^2$=269.5 kg·mm$^2$. Although this is not an exact number for the moment of inertia provided by the mass inside the mass boxes, it does provide a basis for comparison of how the mass in the region of the mass boxes affects MOI in the golf club head such as golf club head 3000. In the current embodiment, the $R_{MOI}=MOI_{eff}/I_{xx}$=269.5 kg·mm$^2$/507 kg·mm$^2$≈0.532.

Figure 4C:
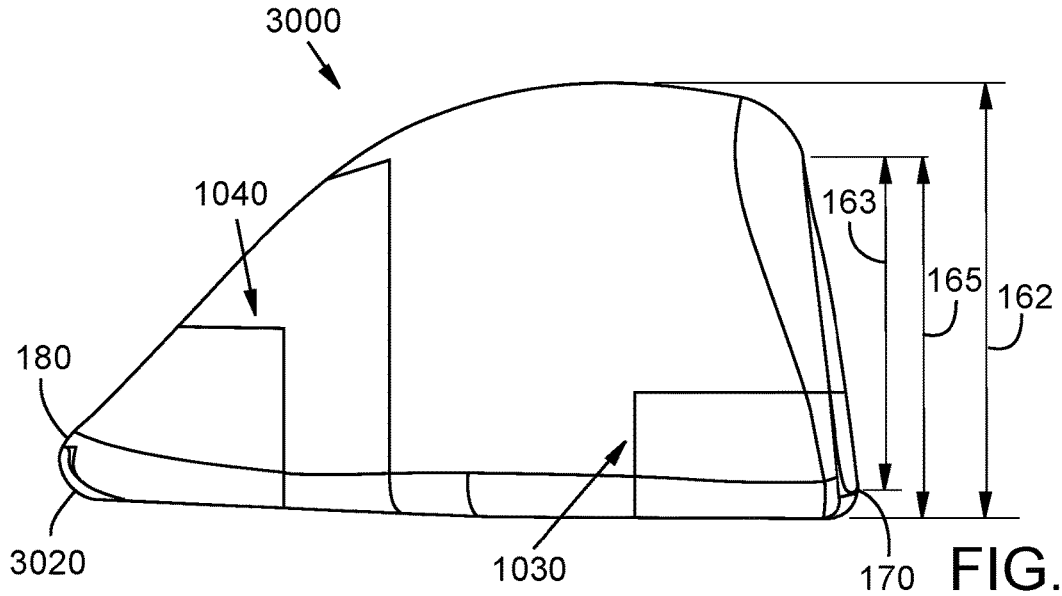
FIG. 4C is a toe side view of the golf club head of FIG. 4A.

The golf club head 3000—as seen with reference to FIG. 4C—includes a face height 165 of about 56.6 mm in the current embodiment. The crown height 162 is about 68.3 mm in the current embodiment. A ratio of the crown height 162 to the face height 165 is 68.3/56.6, or about 1.21. The effective face height 163 is about 53.3 mm.

Figure 4D:
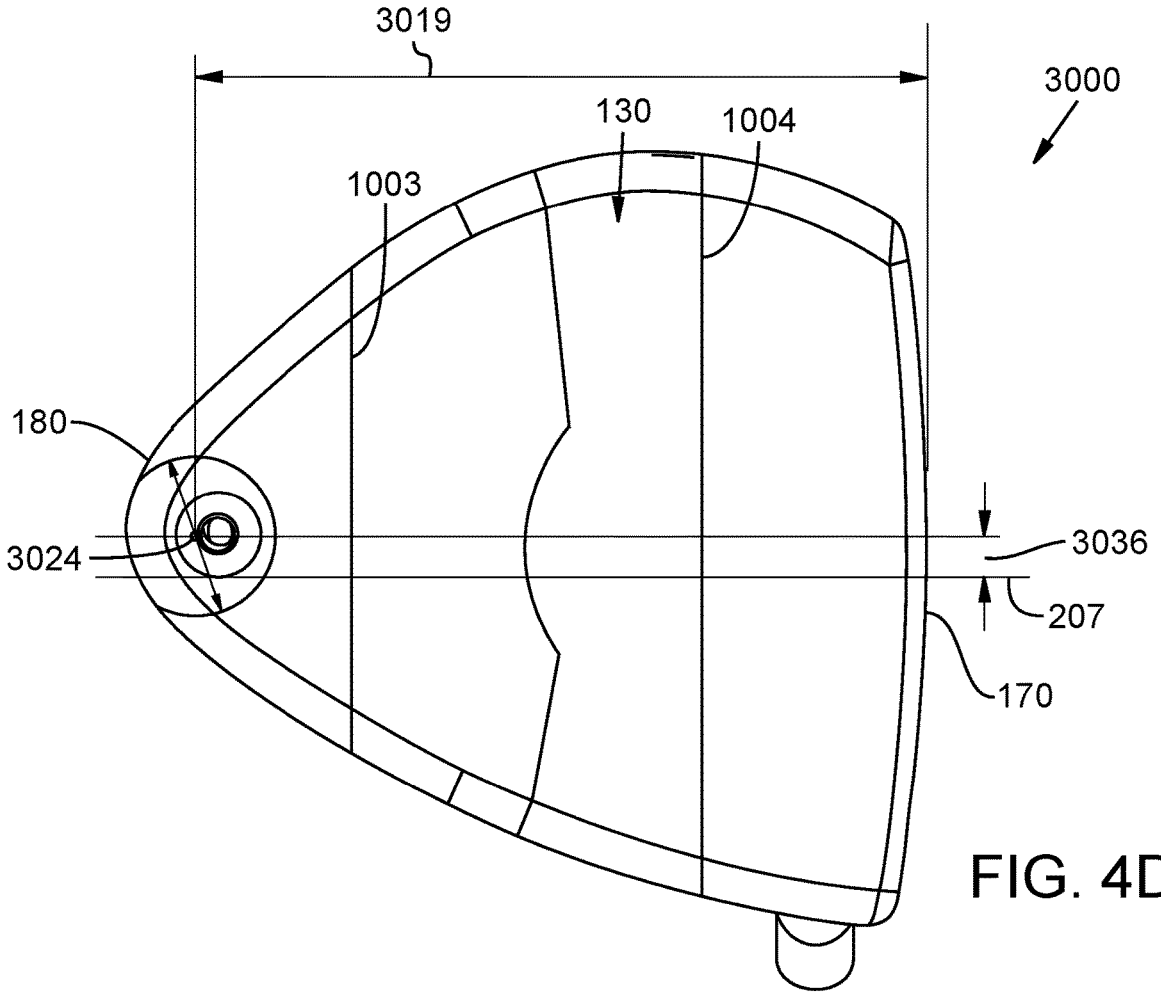
FIG. 4D is a sole side view of the golf club head of FIG. 4A.

As seen with specific reference to FIG. 4D, first mass element 2010 is seen in its proximity to the leading edge 170 as well as to the y-axis 207.

The mass element 3020 of the current embodiment is generally circular with a truncated side. The mass element 3020 has a center point 3024 and a diameter 3023 in the circular portion of the mass element 3020 of about 25 mm. The center point 3024 of the current embodiment is located at a halfway point of the diameter 3023 which is not the same as the geometric center of the mass element 3020 because of the truncated side. In various embodiments, the geometric center of the mass element 3020 may be coincident with the center point 3024. The center point 3024 of the mass element 3020 is located a distance 3036 from the y-axis 207 as measured in a direction parallel to the x-axis 208 (seen in FIG. 4A). The center point 3024 of the mass element 3020 is located a distance 3019 from the leading edge 170 as measured parallel to the y-axis 207. In the current embodiment, the distance 3036 is 2.3 mm and the distance 3019 is 110.2 mm. The mass element 3020 of the current embodiment is partially coincident with and forms the trailing edge 180.

The view of FIG. 4D displays boundaries 1003, 1004 for the forward mass box 1030 and the rearward mass box 1040, respectively. The boundaries 1003, 1004 display the interaction of the mass boxes 1030, 1040 as being projected through the golf club head 2000 at a certain height from the GP (as shown with reference to FIG. 3B). In the current embodiment, the boundaries 1003, 1004 appear flat because the sole 130 is substantially flat in the current embodiment. As such, the view of FIG. 4D provides a mapping of portions of the golf club head 3000 that fall within the mass boxes 1030, 1040.

Figure 5:
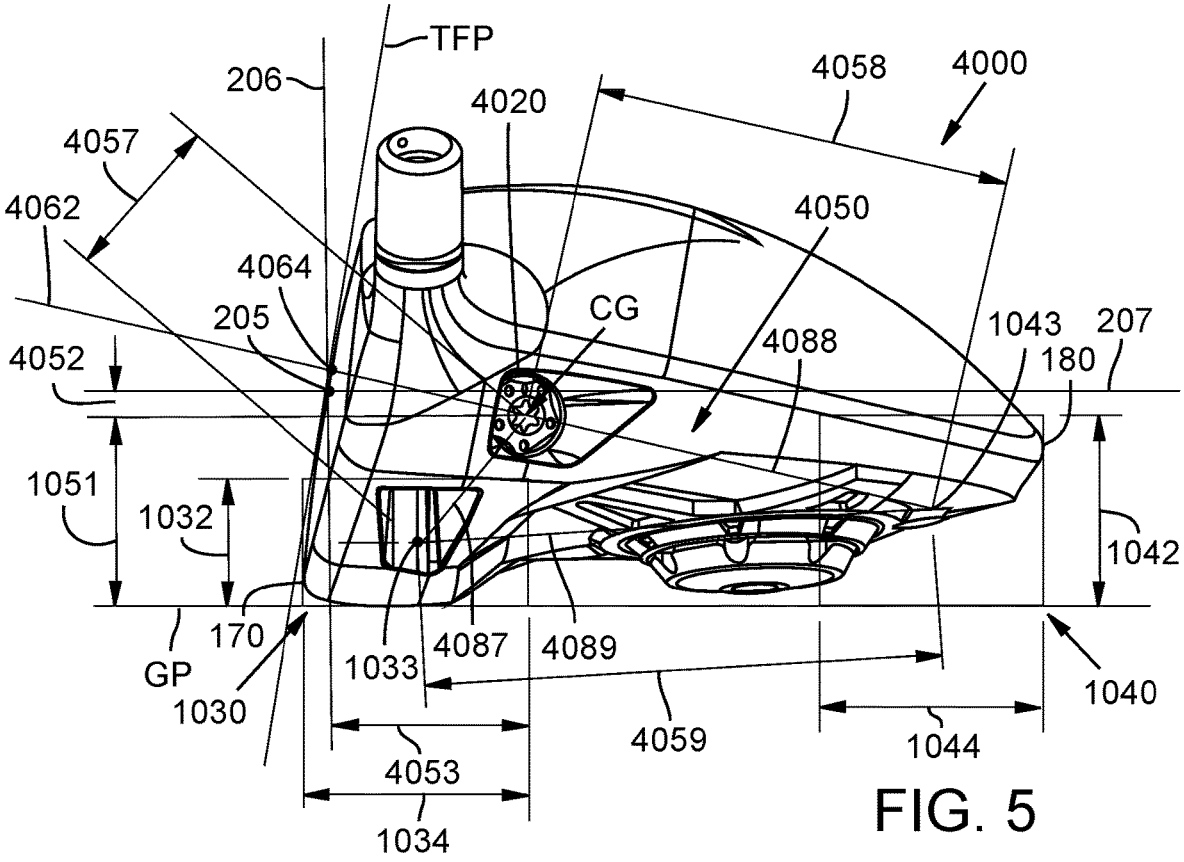
FIG. 5 is a view of a golf club head analyzed according to procedures of the current disclosure.

For comparison, FIG. 5 displays a golf club head 4000. The golf club head 4000 is a production model TaylorMade R1 golf club head. Comparisons for mass boxes 1030, 1040 and moments of inertia, as well as the various other features of the various golf club heads 1000, 2000, 3000 of this disclosure can be made to golf club head 4000, representing a more traditional golf club head design. The golf club head 4000 is of a volume of about 427 CC.

The golf club head 4000 includes a mass element 4020 that is external in the current embodiment. The golf club head 4000 also includes a mass element (not shown) located in a toe portion 185 of the golf club head 4000. The mass element 4020 is 1.3 grams and the mass element in the toe portion 185 is about 10 grams.

The golf club head 4000 is characterized using the same mass boxes 1030, 1040 defined according to the same procedure as used with respect to golf club head 1000. In the current embodiment, the mass boxes 1030, 1040 remain of the same dimensions themselves but are separated by variations in distances from those of golf club heads 1000, 2000, 3000.

In the current embodiment, the forward mass box 1030 encompasses 36.5 grams and the rearward mass box 1040 encompasses 13.2 grams. Additional mass of the golf club head 4000 is 157.7 grams outside of the mass boxes 1030, 1040.

A CG of the golf club head 4000 is seen as annotated in the golf club head 4000. The overall club head CG includes all components of the club head as shown, including any weights or attachments mounted or otherwise connected or attached to the club body. The CG is located a distance 4051 from the ground plane as measured parallel to the z-axis 206. The distance 4051 is also termed $\Delta_Z$ in various embodiments and may be referred to as such throughout the current disclosure. The CG is located a distance 4052 ($CG_Z$) from the origin 205 as measured parallel to the z-axis 206. In the current embodiment, the $CG_Z$ location is −1.9 mm, which means that the CG is located 1.9 mm below center face as measured perpendicularly to the ground plane. The CG is located a distance 4053 ($CG_Y$) from the origin 205 as measured parallel to the y-axis 207. In the current embodiment, the distance 4051 is 29.7 mm, the distance 4052 is −1.9 mm, and the distance 4053 is 31.6 mm.

A first vector distance 4057 defines a distance as measured in the y-z plane from the geometric center point 1033 of the forward mass box 1030 to the CG. In the current embodiment, the first vector distance 4057 is about 26.1 mm. A second vector distance 4058 defines a distance as measured in the y-z plane from the CG to the geometric center point 1043 of the rearward mass box 1040. In the current embodiment, the second vector distance 4058 is about 65.5 mm. A third vector distance 4059 defines a distance as measured in the y-z plane from the geometric center point 1033 of the forward mass box 1030 to the geometric center point 1043 of the rearward mass box 1040. In the current embodiment, the third vector distance 4059 is about 81.2 mm. The effective face height 163 (not shown) of golf club head 4000 is about 54.0 mm. A distance from the leading edge 170 to the center face 205 as measured in the direction of the y-axis 207 is 3.0 mm.

As can be seen, the locations of the CG, the geometric center point 1033, and the geometric center point 1043 form a vector triangle 4050 describing the relationships of the various features. The vector triangle 4050 is for reference and does not appear as a physical feature of the golf club head 4000. The vector triangle 4050 includes a first leg 4087 corresponding to the distance 4057, a second leg 4088 corresponding to the distance 4058, and a third leg 4089 corresponding to the third distance 4059. For calculation of area A and vector ratio VR, distance 4057 is used for a, distance 4058 is used for b, and distance 4059 is used for c in the calculations described above. A of the vector triangle 4050 is 752.47 $mm^2$. VR of the vector triangle 4050 is 1.1281.

A CG projection line 4062 shows the projection of the CG onto the TFP at a CG projection point 4064. The CG projection point 4064 allows for description of the CG in relation to the center face (CF) point at the origin 205. The CG projection point 4064 of the current embodiment is offset from the CF 205. In the current embodiment, the offset distance of the CG projection point 4064 from the CF 205 is about 4.4 mm, meaning that the CG projects about 4.4 mm above center face.

For comparison, for golf club head 4000, $MOI_{eff}$=(36.5 grams)×(26.1 mm)$^2$+(13.2 grams)×(65.5 mm)$^2$≈81,500 g·mm$^2$=81.5 kg·mm$^2$. Although this is not an exact number for the moment of inertia provided by the mass inside the mass boxes, it does provide a basis for comparison of how the mass in the region of the mass boxes affects MOI in the golf club head such as golf club head 4000. In the current embodiment, the $R_{MOI}=MOI_{eff}/I_{xx}$=81.5 kg·mm$^2$/249 kg·mm$^2$≈0.327.

Figure 6:
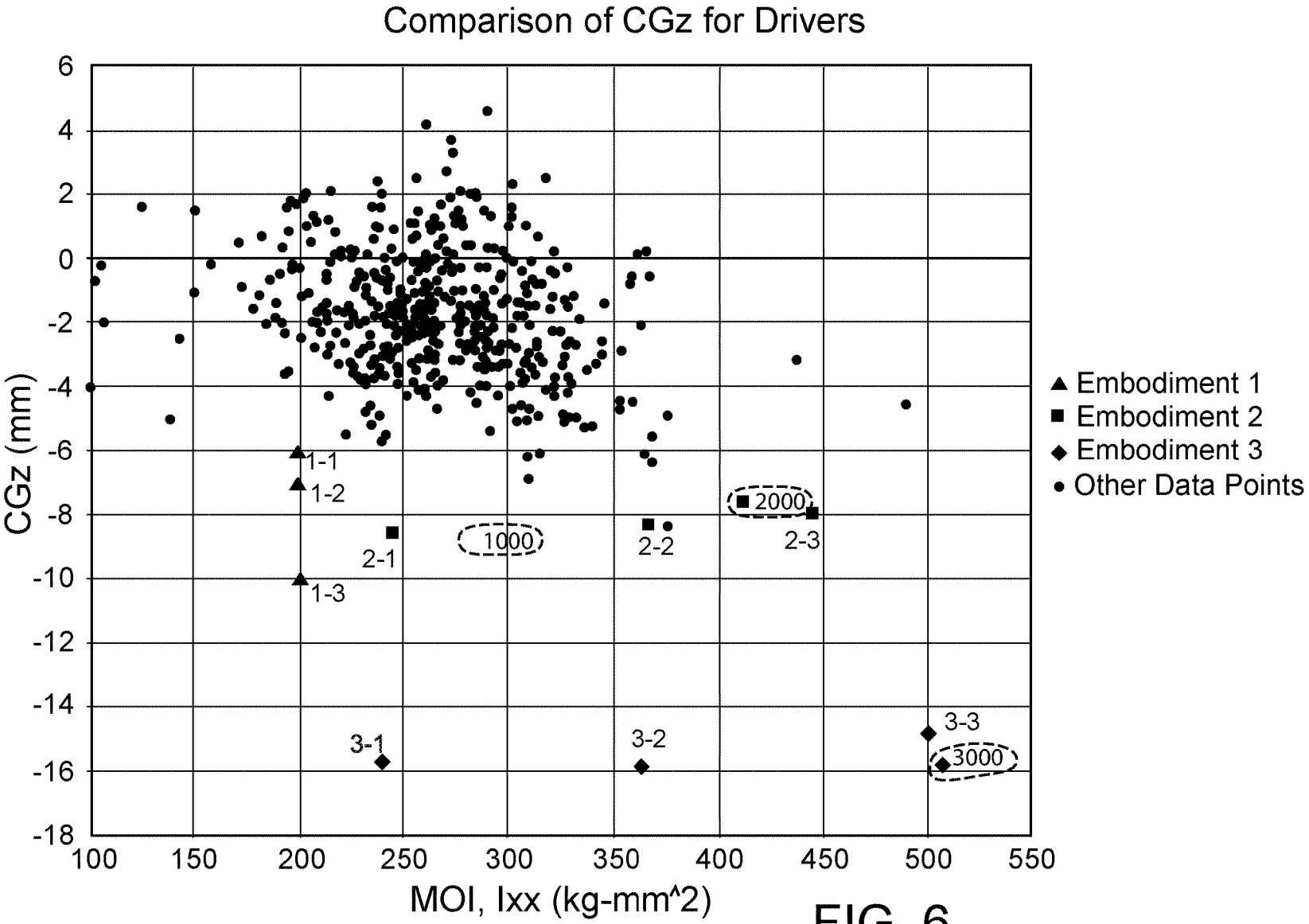
FIG. 6 is a graph displaying features of the golf club heads of the current disclosure as compared to other data points.
Figure 7:
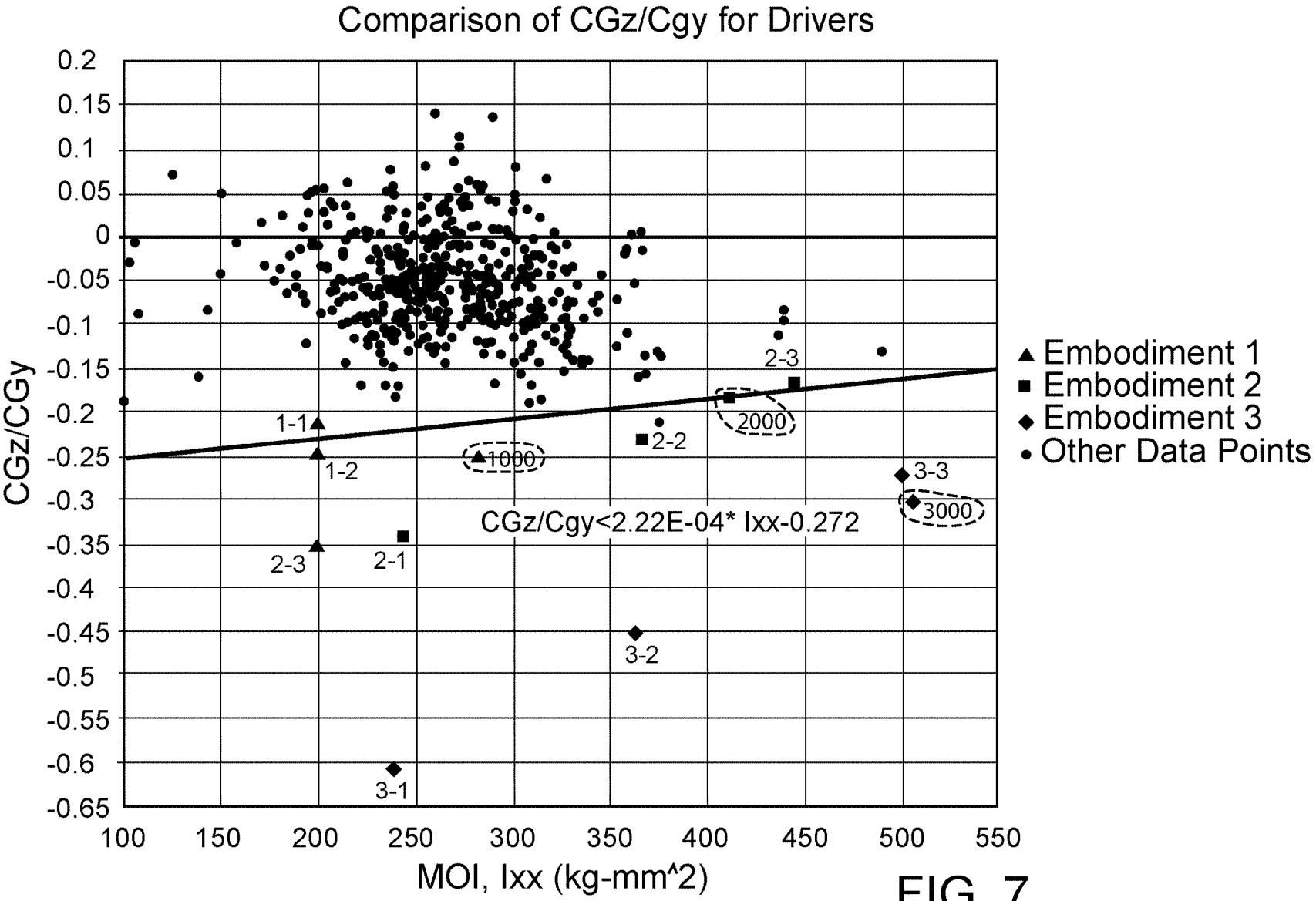
FIG. 7 is a graph displaying features of the golf club heads of the current disclosure as compared to other data points.

For the graphs of FIGS. 6-7, $CG_Y$ is the distance of the center of gravity from the origin of the coordinate system in the direction of the y-axis, which is measured from the center face towards the back of the club orthogonal to the x-axis and the z-axis and parallel to the ground plane when the head is in the address position, as noted elsewhere in this disclosure with respect to specific golf club heads 1000, 2000, 3000, 4000. Data points shown in FIGS. 6-7 include embodiments similar to golf club head 1000 (denoted as Embodiment 1), embodiments similar to golf club head 2000 (denoted as Embodiment 2), embodiments similar to golf club head 3000 (denoted as Embodiment 3), and other data points on golf club heads not within the scope of the current disclosure. As can be see, the specific embodiments of golf club heads 1000, 2000, 3000 are plotted (and included with dotted outlines to illustrate specific data points). Variances with the various versions of Embodiment 1, Embodiment 2, and Embodiment 3 alter CG position within the each embodiment by altering the positioning of mass. For example, with respect to Embodiment 3, point 3-1 includes mass located in a front portion of the golf club head 3000, point 3-2 includes mass distributed in various locations along the golf club head 3000, and point 3-3 includes mass located primarily in the rear of the golf club head 3000. Points 2-1, 2-2, and 2-3 characterize variations of Embodiment 2 similarly to points 3-1, 3-2 and 3-3, respectively.

Points 1-1, 1-2, and 1-3 characterize variations of Embodiment 1. Specifically, points 1-1, 1-2 and 1-3 represent three variations of Embodiment 1 with mass in a low front portion of the club head, whereas the specific embodiment 1000 has mass in a low rear portion of the club head. The $CG_z$ value for each variation differs because the club head mass for each variation differs, whereas the MOI value for each variation is approximately the same because the shape of the head is approximately the same.

As can be seen, data points of the current disclosure have a combination of $CG_Z$, $CG_Y$, and MOI that is not found in other data points. With specific reference to FIG. 7, a boundary line is seen distinguishing the golf club heads 1000, 2000, 3000 of the current disclosure (and their respective variations, except for the point 1-1 variation) from other data points. The boundary line indicates that golf club heads 1000, 2000, 3000 of the current disclosure generally include a ratio of $CG_Z/CG_Y<0.000222\times I_{XX}-0.272$. Individual species of golf club heads 1000, 2000, 3000 follow different curves, and the inequality displayed above is intended to indicate a ratio covering most embodiments of the current disclosure.

Figure 8:
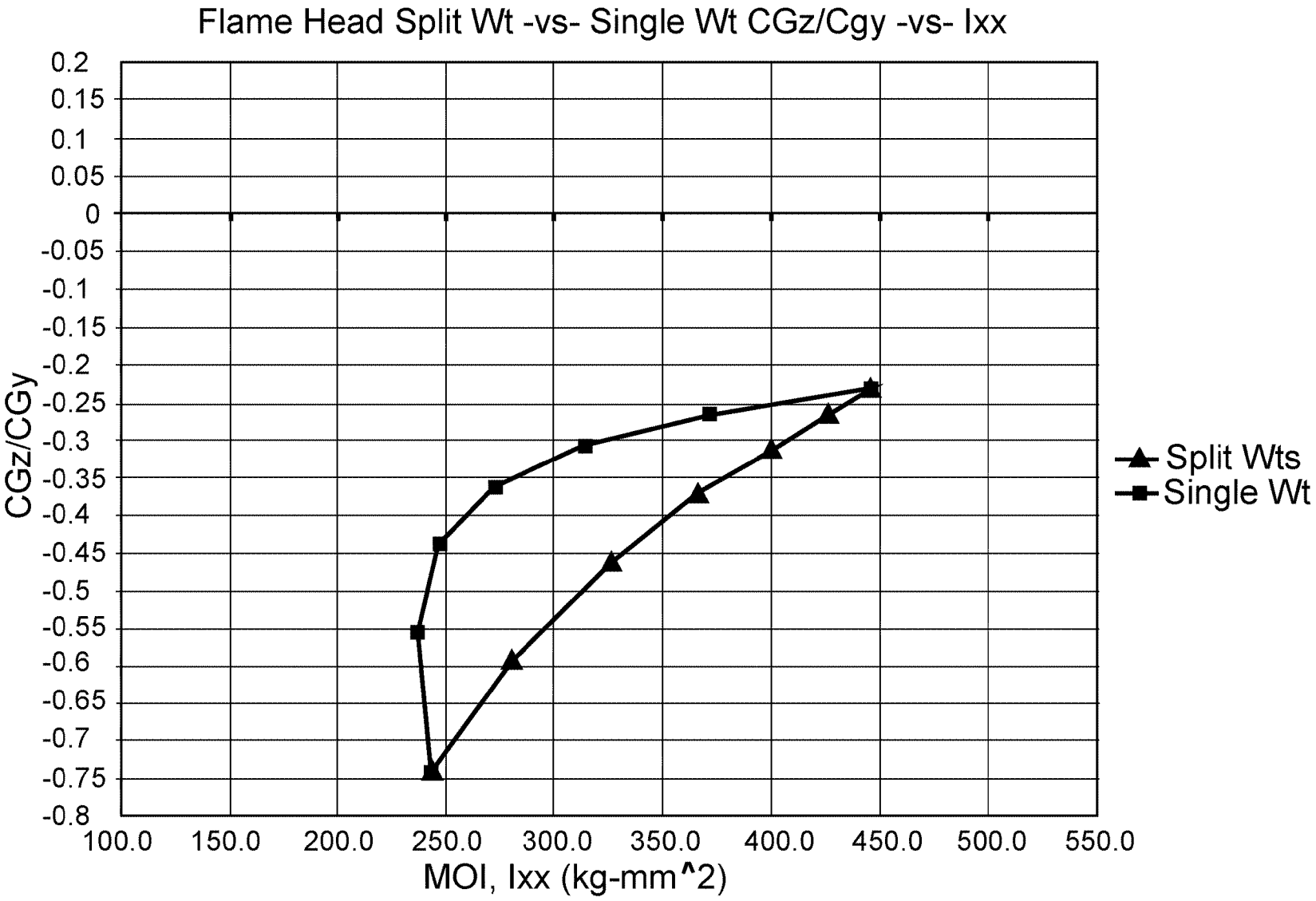
FIG. 8 is a graph illustrating the effectiveness of the golf club heads of the current disclosure.

As illustrated by FIG. 8, $CG_Z/CG_Y$ provides a measure of how low the CG projects on the face of the golf club head. Although $CG_Z/CG_Y$ may be various numbers, the chart of FIG. 8 displays the same golf club head geometry (that of Embodiment 2, similar to golf club head 2000) with one mass and with multiple masses. In the embodiment of the current figure, the multiple masses included two masses, one located proximate the leading edge 170 and one located proximate the trailing edge 180, although various embodiments may include various arrangements of masses. For the single mass, a single mass was varied throughout the golf club head to achieve varying MOIs, from very far forward to very far rearward. With split masses, two masses were placed on the periphery of the golf club head and the amount of mass was varied from all mass at the front to all mass at the back. With such an experiment, the single mass would be capable of achieving similar properties along one of $CG_Z/CG_Y$ or MOI. As can be seen, the single mass and split mass curves approach each other at their ends. This is because, as balance of mass among the split mass embodiments becomes more heavily unbalanced to one end or the other, the mass distribution in the golf club head approaches that of a single mass.

However, it is important to note that, with the multiple mass embodiments, higher MOI can be achieved with a lower $CG_Z/CG_Y$ ratio. Stated differently, although single mass efforts may be capable of producing the same $CG_Z/CG_Y$ ratio, the MOI for the golf club head with a single mass would be lower than the MOI for the golf club head with multiple masses. Stated differently yet again, for the same MOI, the multiple-mass embodiments of the golf club head would be able to achieve a lower $CG_Z/CG_Y$ ratio. Effectively, the result is that CG projection can be moved lower in the golf club head while maintaining relatively high MOI. The effectiveness of this difference will be determined by the specific geometry of each golf club head and the masses utilized.

Knowing $CG_Y$ allows the use of a CG effectiveness product to describe the location of the CG in relation to the golf club head space. The CG effectiveness product is a measure of the effectiveness of locating the CG low and forward in the golf club head. The CG effectiveness product ($CG_{eff}$) is calculated with the following formula and, in the current disclosure, is measured in units of the square of distance ($mm^2$):

$$CG_{eff}=CG_Y\times\Delta_z$$

With this formula, the smaller the $CG_{eff}$, the more effective the club head is at relocating mass low and forward. This measurement adequately describes the location of the CG within the golf club head without projecting the CG onto the face. As such, it allows for the comparison of golf club heads that may have different lofts, different face heights, and different locations of the CF. For golf club head 1000, $CG_Y$ is 33.3 mm and $\Delta_z$ is 24.2 mm. As such, the $CG_{eff}$ of golf club head 1000 is about 806 $mm^2$. For golf club head 2000, $CG_Y$ is 41.9 mm and $\Delta_z$ is 24.6 mm. As such, the $CG_{eff}$ of golf club head 2000 is about 1031 $mm^2$. For golf club head 3000, $CG_Y$ is about 52.8 and $\Delta_z$ is 18.7 mm. As such, the $CG_{eff}$ of golf club head 3000 is about 987 $mm^2$. For comparison, golf club head 4000, $CG_Y$ is 31.6 mm and $\Delta_z$ is 29.7 mm. As such $CG_{eff}$ is about 938.52 $mm^2$.

As described briefly above, loft adjustable loft technology is described in greater detail with reference to U.S. Pat. No. 7,887,431, entitled "GOLF CLUB," filed Dec. 30, 2008, which is incorporated by reference herein in its entirety. An illustration of loft sleeve 1072 is seen with reference to FIG. 9.

Figure 9:
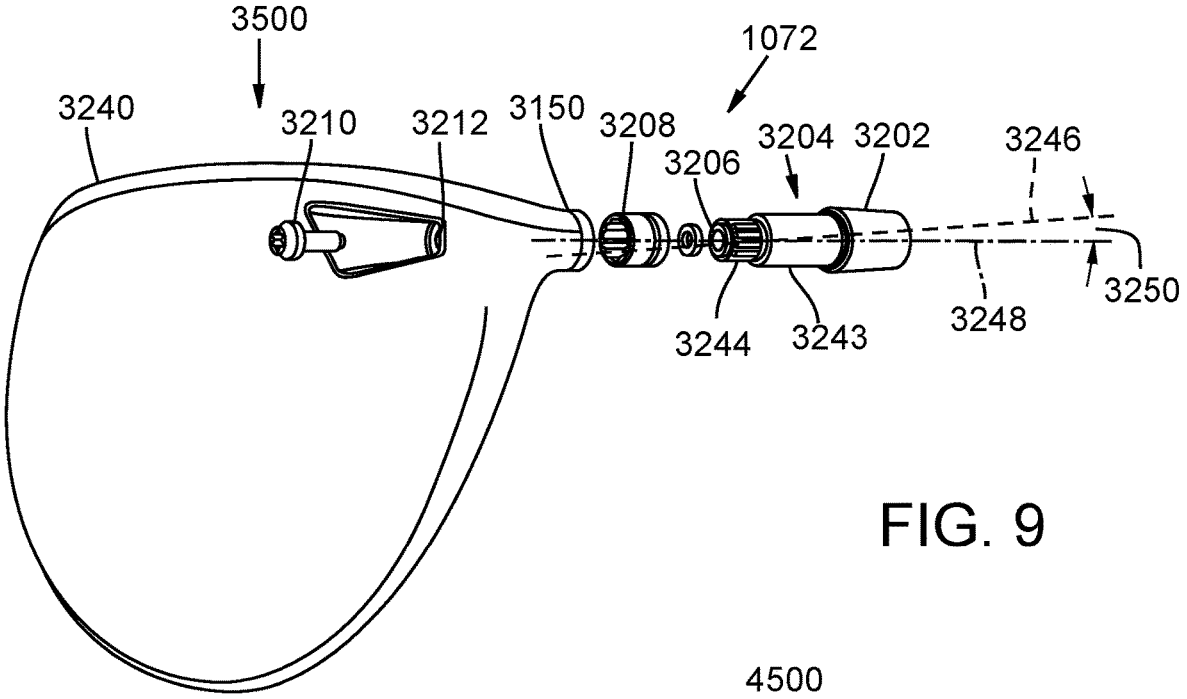
FIG. 9 is an exploded perspective view an adjustable golf club technology in accord with at least one embodiment of the current disclosure.

FIG. 9 illustrates a removable shaft system having a ferrule 3202 having a sleeve bore 3245 (shown in FIG. 2B) within a sleeve 3204. A shaft (not shown) is inserted into the sleeve bore and is mechanically secured or bonded to the sleeve 3204 for assembly into a golf club. The sleeve 3204 further includes an anti-rotation portion 3244 at a distal tip of the sleeve 3204 and a threaded bore 3206 for engagement with a screw 3210 that is inserted into a sole opening 3212 defined in an exemplary golf club head 3500, as the technology described herein may be incorporated in the various embodiments of golf club heads of the current disclosure. In one embodiment, the sole opening 3212 is directly adjacent to a sole non-undercut portion. The anti-rotation portion 3244 of the sleeve 3204 engages with an anti-rotation collar 3208 which is bonded or welded within a hosel 3150 of the exemplary golf club head 3500.

The technology shown in FIG. 9 includes an adjustable loft, lie, or face angle system that is capable of adjusting the loft, lie, or face angle either in combination with one another or independently from one another. For example, a first portion 3243 of the sleeve 3204, the sleeve bore 3242, and the shaft collectively define a longitudinal axis 3246 of the assembly. The sleeve 3204 is effective to support the shaft along the longitudinal axis 3246, which is offset from a longitudinal axis 3248 offset angle 3250. The longitudinal axis 3248 is intended to align with the axis of the hosel 150. The sleeve 3204 can provide a single offset angle 3250 that can be between 0 degrees and 4 degrees, in 0.25 degree increments. For example, the offset angle can be 1.0 degree, 1.25 degrees, 1.5 degrees, 1.75 degrees, 2.0 degrees or 2.25 degrees. The sleeve 3204 can be rotated to provide various adjustments the loft, lie, or face angle of the golf club head 3500. One of skill in the art would understand that the system described with respect to the current golf club head 3500 can be implemented with various embodiments of the golf club heads (1000, 2000, 3000) of the current disclosure.

In various embodiments, the golf club heads 1000, 2000, 3000 may include composite face plates, composite face plates with titanium covers, or titanium faces as desired as described with reference to U.S. Pat. No. 7,874,936, entitled "COMPOSITE ARTICLES AND METHODS FOR MAKING THE SAME," filed Dec. 19, 2007. In various embodiments, other materials may be used and would be understood by one of skill in the art to be included within the general scope of the disclosure.

Figure 10:
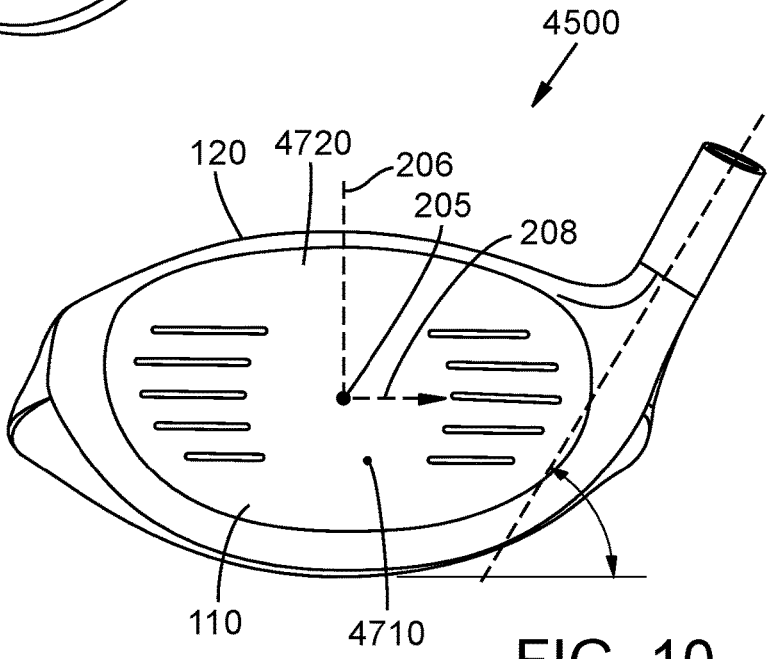
FIG. 10 is a front side view of a golf club head including a composite face plate in accord with at least one embodiment of the current disclosure.

One exemplary composite face plate is included and described with reference to FIG. 10. An exemplary golf club head 4500 includes face 110 that is a composite face plate. The composite face plate includes a striking portion 4710 and a partial crown portion 4720 that allows a portion of the composite face plate to be included in the crown 120 of the golf club head 4500. Such an arrangement can reduce mass in the golf club head 4500 by 10-15 grams in various embodiments. In various embodiments, composite face plates need not include portions along the crown 120 of the golf club head 4500. In various embodiments, the face 110 may be of various materials and arrangements, and no single embodiment should be considered limiting on the scope of the current disclosure.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

The invention claimed is:

1. A golf club head comprising:

a club head body having a crown, a sole, a heel, and a toe;

a face portion connected to a front end of the club head body, the face portion including a geometric center defining an origin of a coordinate system when the golf club head is in a normal address position; and a face-to-crown transition where the face connects to the crown near the front end of the club head body, wherein the coordinate system includes:

an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis;

the golf club head defining a center of gravity (CG), the CG being a distance $CG_y$ from the origin as measured along the y-axis and a distance $CG_z$ from the origin as measured along the z-axis;

wherein in a y-z plane passing through the origin the crown height continuously increases starting from the face-to-crown transition up to a local maximum;

wherein a CG effectiveness product ($CG_{eff}$) for the golf club head is defined as $CG_{eff}=CG_y \times \Delta_z$ and the $CG_{eff}$ is at least 806 $mm^2$; and wherein the golf club head further comprises a sole feature, the sole feature comprising an extended platform formed in the sole, the extended platform extending rearwardly from a first end to a second end, and further comprising:

a planar sole surface and opposed sloped portions that, when the golf club head is in a normal address position, slope away from the ground plane toward the crown, the opposed sloped portions comprising a sloped heel side portion positioned heelward of the planar sole surface and a sloped toe side portion positioned toeward of the planar sole surface;

a forward portion adjacent the first end; and a rearward portion adjacent the second end, wherein the extended platform has a first center point positioned at the first end and a second center point positioned at the second end, and wherein the second center point is positioned toeward of the first center point and toeward of the y-axis.

2. The golf club head of claim 1, wherein the golf club head has a crown height to face height ratio of at least 1.12.

3. The golf club head of claim 1, wherein in a y-z plane passing through the origin at a distance $CG_y$ from the origin, the crown height is greater than the face height.

4. The golf club head of claim 1, wherein in a y-z plane passing through the origin a rearmost portion of a trailing edge of the golf club head is lower than the origin.

5. The golf club head of claim 1, wherein the $CG_{eff}$ is no more than 1031 $mm^2$.

6. The golf club head of claim 1, wherein the extended platform extends rearwardly at an angle along a flow direction from the first end to the second end.

7. The golf club head of claim 6, wherein the angle of the flow direction from the first center point to the second center point relative to the y-axis is at least 11 degrees.

8. The golf club head of claim 6, wherein the angle of the flow direction from the first center point to the second center point relative to the y-axis is at least 9 degrees.

9. The golf club head of claim 6, wherein the extended platform has a length extending between the first end and the second end, and a width that is normal to the length, and further wherein the width measured at a plurality of locations along the length is approximately constant.

10. The golf club head of claim 1, further comprising at least one first mass element connected to the club head body of the golf club head forward of the extended platform.

11. The golf club head of claim 10, further comprising at least one second mass element connected to the extended platform.

12. The golf club head of claim 11, wherein the second mass element is positioned in the rearward portion of the extended platform.

13. The golf club head of claim 1, further comprising at least one mass element connected to the extended platform.

14. The golf club head of claim 13, wherein the at least one mass element is positioned in the rearward portion of the extended platform.

15. The golf club head of claim 1, further comprising an adjustable head-shaft connection assembly coupled to the club head body and operable to adjust at least one of a loft angle or a lie angle of a golf club formed when the golf club head is attached to a golf club shaft via the head-shaft connection assembly.

16. The golf club head of claim 15, further comprising:

a heel opening located on the heel end of the club head body, the heel opening configured to receive a shaft fastening member; and a sleeve that is secured by the shaft fastening member in a locked position to secure the adjustable head-shaft connection assembly.

17. The golf club head of claim 1, wherein the face portion comprises a composite face plate.

18. A golf club head comprising:

a club head body having a crown, a sole, a heel, and a toe;

a face portion connected to a front end of the club head body, the face portion including a geometric center defining an origin of a coordinate system when the golf club head is in a normal address position; and a face-to-crown transition where the face connects to the crown near the front end of the club head body, wherein the coordinate system includes:

an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis;

the golf club head defining a center of gravity (CG), the CG being a distance $CG_y$ from the origin as measured along the y-axis and a distance $CG_z$ from the origin as measured along the z-axis;

wherein in a y-z plane passing through the origin the crown height continuously increases starting from the face-to-crown transition up to a local maximum;

wherein a CG effectiveness product ($CG_{eff}$) for the golf club head is defined as $CG_{eff}=CG_y \times \Delta_z$ and the $CG_{eff}$ is at least 806 $mm^2$; and wherein the golf club head further comprises a sole feature, the sole feature comprising an extended platform formed in the sole, the extended platform extending rearwardly and angled toewardly from a first end to a second end, and further comprising:

a planar sole surface and opposed sloped portions that, when the golf club head is in a normal address position, slope away from the ground plane toward the crown, the opposed sloped portions comprising a sloped heel side portion positioned heelward of the planar sole surface and a sloped toe side portion positioned toeward of the planar sole surface;

a forward portion adjacent the first end having a first center point; and a rearward portion adjacent the second end having a second center point, wherein the second center point is positioned toeward of the first center point.

19. The golf club head of claim 18, wherein in a y-z plane passing through the origin at a distance $CG_y$ from the origin, the crown height is greater than the face height.

20. The golf club head of claim 18, wherein the $CG_{eff}$ is no more than 1031 $mm^2$.

21. The golf club head of claim 18, wherein in a y-z plane passing through the origin a rearmost portion of a trailing edge of the golf club head is lower than the origin.

22. The golf club head of claim 18, further comprising at least one first mass element connected to the extended platform.

23. The golf club head of claim 22, wherein the first mass element is positioned in the rearward portion of the extended platform.

24. The golf club head of claim 23, further comprising a second mass element connected to the club head body forward of the extended platform.

25. The golf club head of claim 22, wherein the face portion comprises a composite face plate.

26. The golf club head of claim 22, further comprising an adjustable head-shaft connection assembly coupled to the club head body and operable to adjust at least one of a loft angle or a lie angle of a golf club formed when the golf club head is attached to a golf club shaft via the head-shaft connection assembly.

27. The golf club head of claim 18, wherein the extended platform extends rearwardly at an angle along a flow direction from the first end to the second end, and wherein the angle of the flow direction from the first center point to the second center point relative to the y-axis is at least 9 degrees.

28. A golf club head comprising:

a club head body having a crown, a sole, a heel, and a toe;

a face portion connected to a front end of the club head body, the face portion including a geometric center defining an origin of a coordinate system when the golf club head is in a normal address position; and a face-to-crown transition where the face connects to the crown near the front end of the club head body, wherein the coordinate system includes:

an x-axis being tangent to the face portion at the origin and parallel to a ground plane, a y-axis intersecting the origin being parallel to the ground plane and orthogonal to the x-axis, and a z-axis intersecting the origin being orthogonal to both the x-axis and the y-axis;

the golf club head defining a center of gravity (CG), the CG being a distance $CG_y$ from the origin as measured along the y-axis and a distance $CG_z$ from the origin as measured along the z-axis;

wherein in a y-z plane passing through the origin the crown height continuously increases starting from the face-to-crown transition up to a local maximum;

wherein a CG effectiveness product ($CG_{eff}$) for the golf club head is defined as $CG_{eff}=CG_y \times \Delta_z$ and the $CG_{eff}$ is at least 806 $mm^2$ and no more than 1031 $mm^2$; and wherein the golf club head further comprises a sole feature, the sole feature comprising an extended platform formed in the sole, the extended platform extending rearwardly from a first end to a second end, and further comprising:

a planar sole surface and opposed sloped portions that, when the golf club head is in a normal address position, slope away from the ground plane toward the crown, the opposed sloped portions comprising a sloped heel side portion positioned heelward of the planar sole surface and a sloped toe side portion positioned toeward of the planar sole surface;

a forward portion adjacent the first end; and a rearward portion adjacent the second end;

wherein the extended platform has a first center point positioned at the first end and a second center point positioned at the second end and wherein the second center point is positioned toeward of the y-axis and toeward of the first center point.

29. The golf club head of claim 28, further comprising at least one first mass element connected to the extended platform.

30. The golf club head of claim 28, wherein the extended platform extends rearwardly at an angle along a flow direction from the first end to the second end, and wherein the angle of the flow direction from the first center point to the second center point relative to the y-axis is at least 9 degrees.

* * * * *